United States Patent [19]

Nagao

[11] 4,205,281

[45] May 27, 1980

[54] FERRITE COMPOSITE CIRCULATOR

[76] Inventor: Tsukasa Nagao, 4-75, Mabori, Yokosuka-shi, Kanagawa-ken, Japan

[21] Appl. No.: 906,374

[22] Filed: May 16, 1978

Related U.S. Application Data

[63] Continuation-in-part of Ser. No. 683,143, May 4, 1976, Pat. No. 4,122,418.

[30] Foreign Application Priority Data

May 10, 1975 [JP] Japan ..... 50-54922
Apr. 19, 1976 [JP] Japan ..... 51-44760

[51] Int. Cl.[2] ..... H01P 1/38
[52] U.S. Cl. ..... 333/1.1; 333/246
[58] Field of Search ..... 333/1.1

[56] References Cited

U.S. PATENT DOCUMENTS 3,350,663 10/1967 Siekanowicz et al. ..... 333/1.1
3,422,375 1/1969 Omori ..... 333/1.1

*Primary Examiner*—Paul L. Gensler
*Attorney, Agent, or Firm*—Ladas, Parry, Von Gehr, Goldsmith & Deschamps

[57] ABSTRACT

A ferrite composite circulator according to the present invention performs various circulator actions with ferrite composites in which resonant TM modes and relevant circulating modes are utilized in multiple. Circulator performances are categorized into broadband operation, frequency dividing operation, and others, from the viewpoint of multiple circulation frequency operation. These operations have a common basis on the finding of multiple circulation frequency operation which has been achieved with a ferrite-dielectric composite circulator. Three types of ferrite composites used are a ferrite-conductor composite, a ferrite-dielectric-conductor composite, and a ferrite-ferrite composite.

3 Claims, 57 Drawing Figures

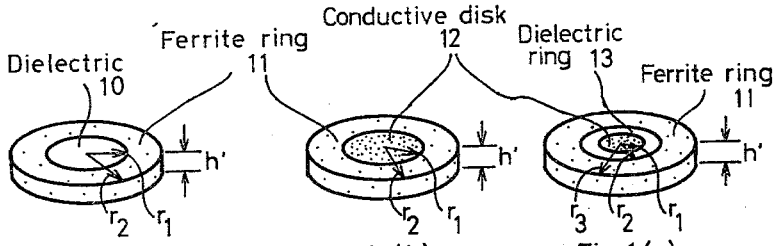
Fig. 1-(a) Fig. 1-(b) Fig. 1-(c)
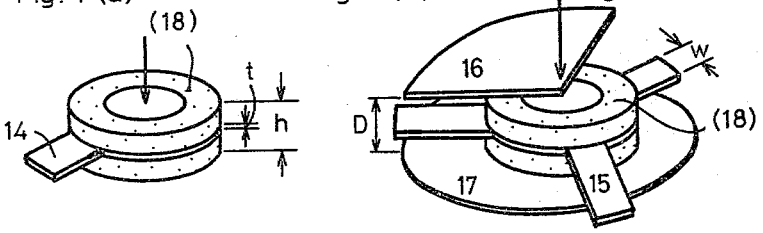
Fig. 2-(a) Fig. 2-(b)
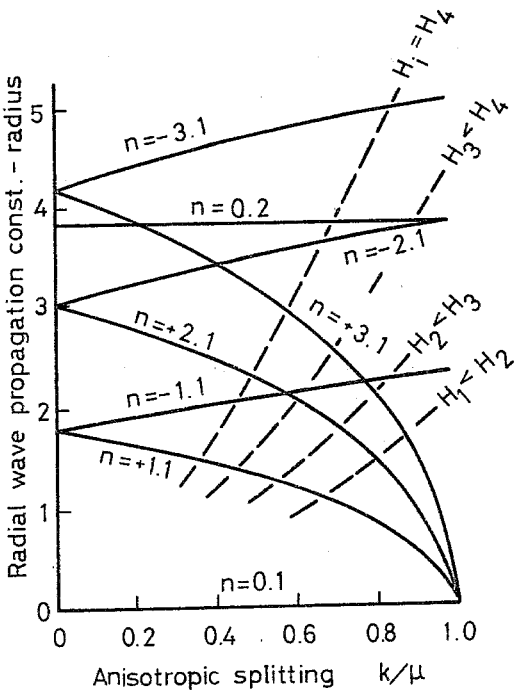
Fig. 3-(a)
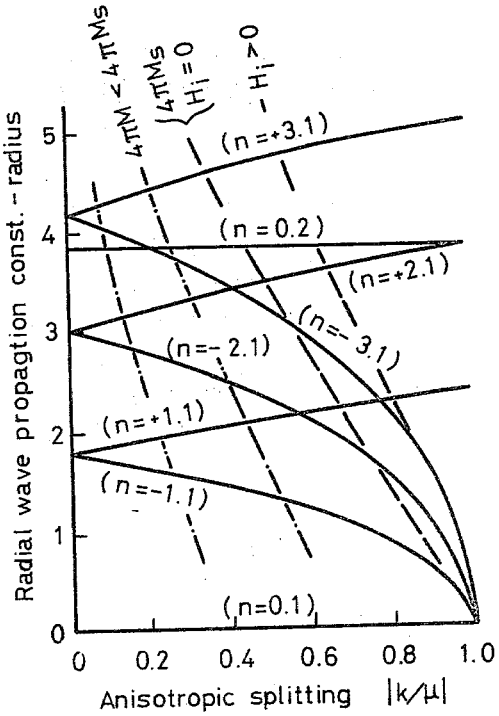
Fig. 3-(b)

Fig. 6
| | MODE PAIR | EXAMPLES OF STANDING WAVE PATTERNS |
|---|---|---|
| A | n=-1, +1 | 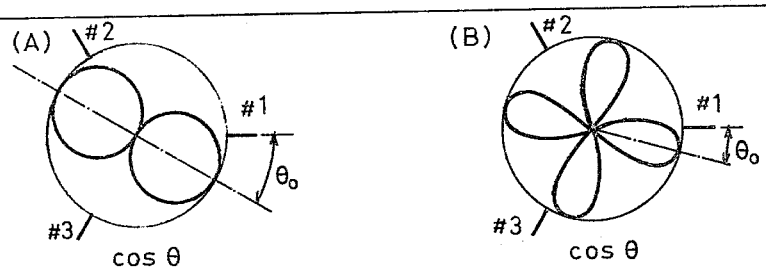  |
| B | n=-2, +2 | |
| | MODE PAIR | EXAMPLES OF NON-STANDING WAVE PATTERNS: Stationary pattern | Rotating pattern | Example of resultant patterns |
|---|---|---|---|---|
| C | n=-1, +2 | 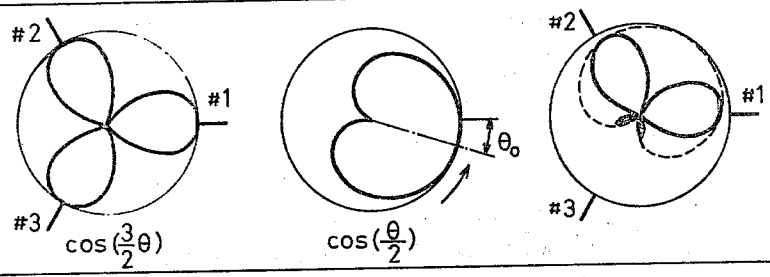  | | |
| D | n=-2, +3 | 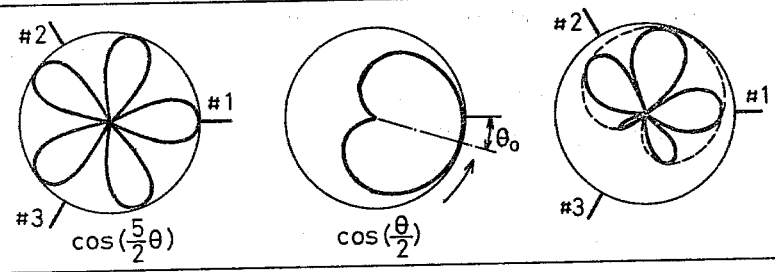  | | |
| E | n=-1, +3 | 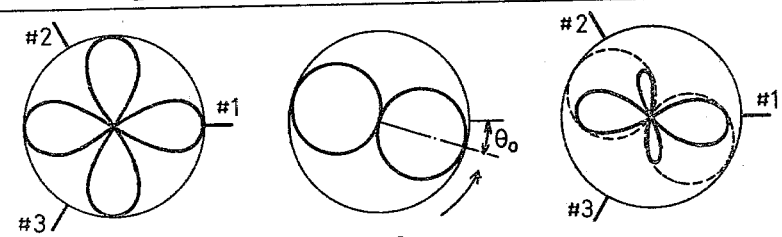  | | |
| F | n=-2, +4 | 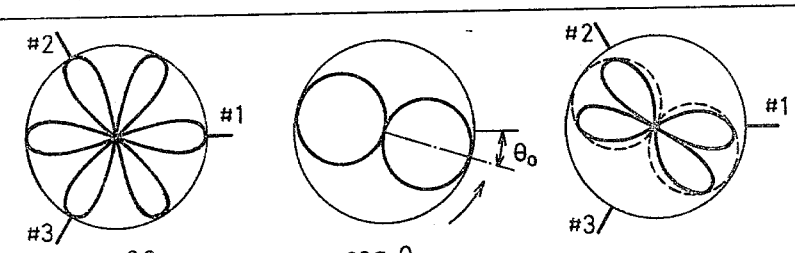  | | |

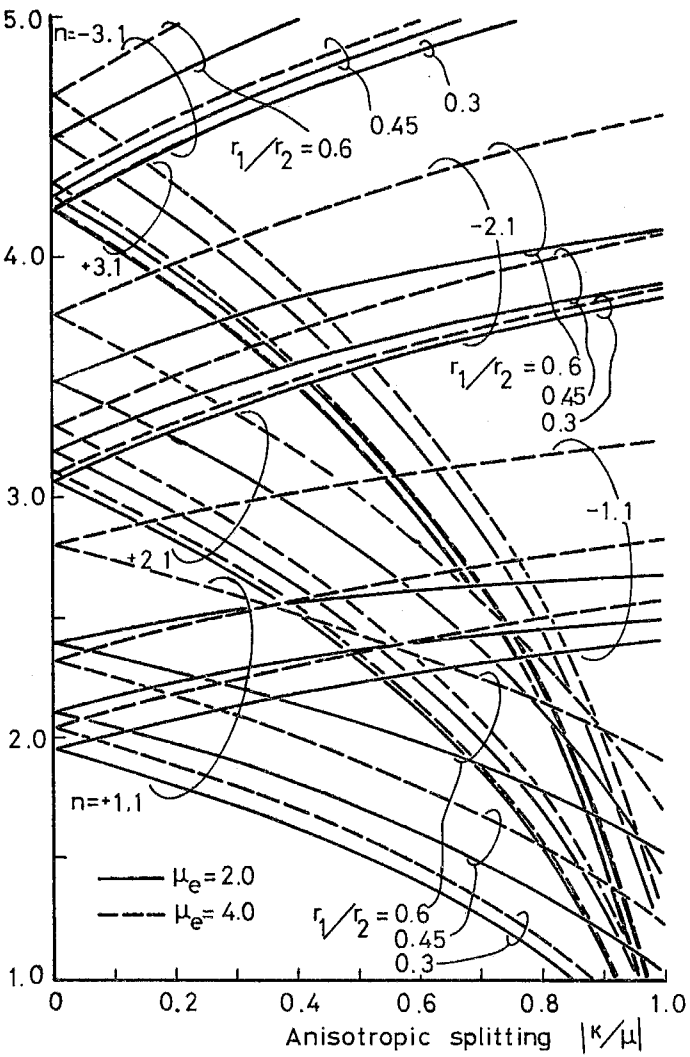
Fig.7
$k_2 r_2$
5.0
4.0
3.0
2.0
1.0
0
0.2
0.4
0.6
0.8
1.0
Anisotropic splitting $|\kappa/\mu|$
n=-3.1
+3.1
-2.1
+2.1
-1.1
n=+1.1
$r_1/r_2$ = 0.6
0.45
0.3
$\mu_e$ = 2.0
$\mu_e$ = 4.0

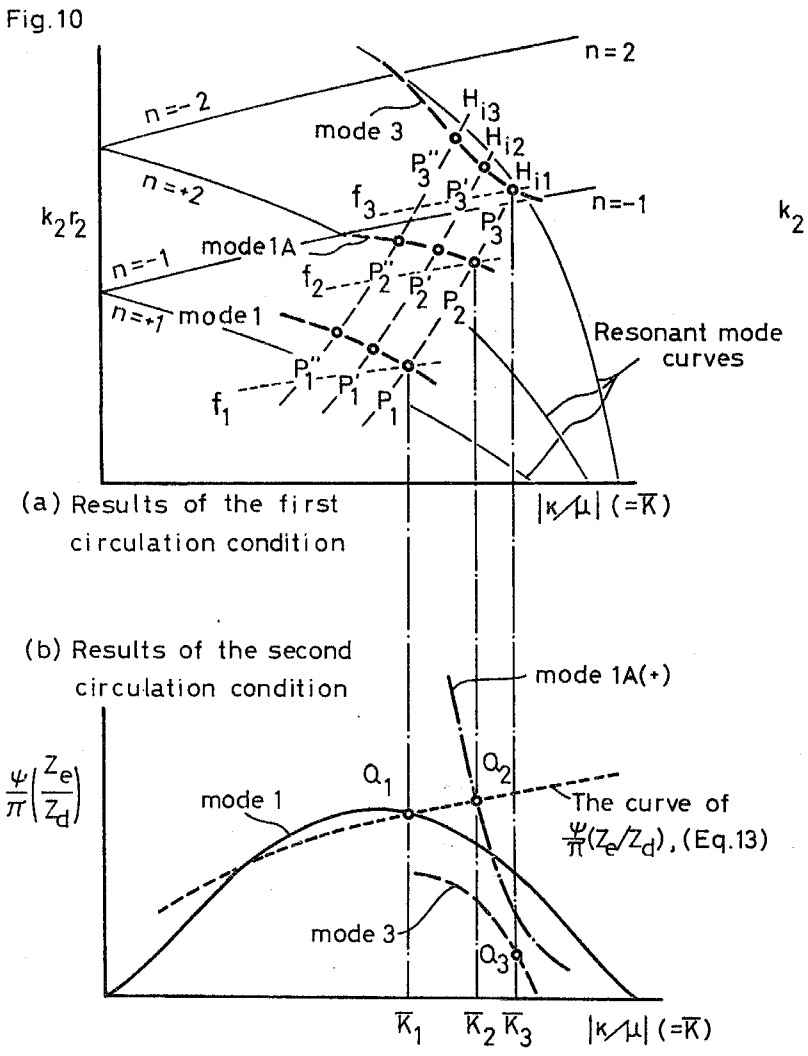
Fig.10
$k_2 r_2$
n=2
n=-2
n=+2
n=-1
n=+1
mode 3
mode1A
mode 1
$H_{i3}$
$H_{i2}$
$H_{i1}$
$P_3''$
$P_3'$
$P_3$
$P_2''$
$P_2'$
$P_2$
$P_1''$
$P_1'$
$P_1$
$f_3$
$f_2$
$f_1$
Resonant mode curves
$|\kappa/\mu|$ (=$\bar{\kappa}$)
(a) Results of the first circulation condition
mode 1A(+)
The curve of $\frac{\psi}{\pi}(Z_e/Z_d)$, (Eq.13)
$Q_1$
$Q_2$
$Q_3$
mode 1
mode 3
$\frac{\psi}{\pi}\left(\frac{Z_e}{Z_d}\right)$
$\bar{\kappa}_1$
$\bar{\kappa}_2$
$\bar{\kappa}_3$
$|\kappa/\mu|$ (=$\bar{\kappa}$)
(b) Results of the second circulation condition $k_2 r_2$
$|k/\mu|$
mode 3
mode 1A
$\psi$=0.8
$\psi$=0.6
$\psi$=2
$\psi$=1.0
mode 1
$\mu_e$ = 6.0
$\mu_e$ = 4.0
$\mu_e$ = 2.0

$\frac{\psi}{\pi}\left(\frac{Z_e}{Z_d}\right)$
mode 1A(−)
mode 1A(+)
mode 1
mode 3
(a)
(b)
(c)

Fig.11-a
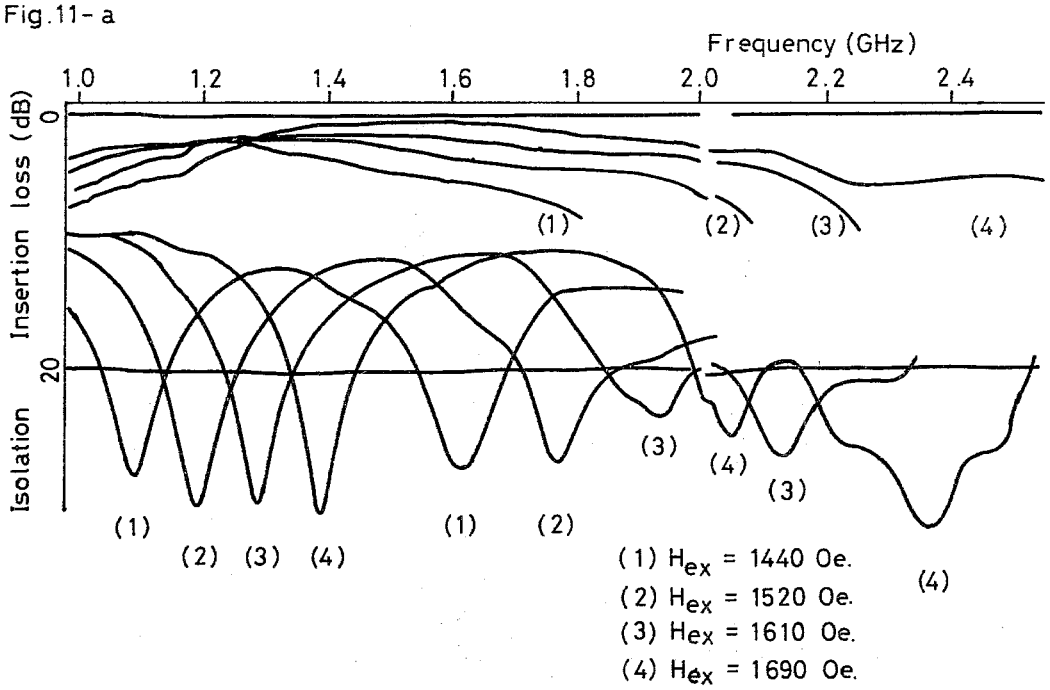
Fig.11-b
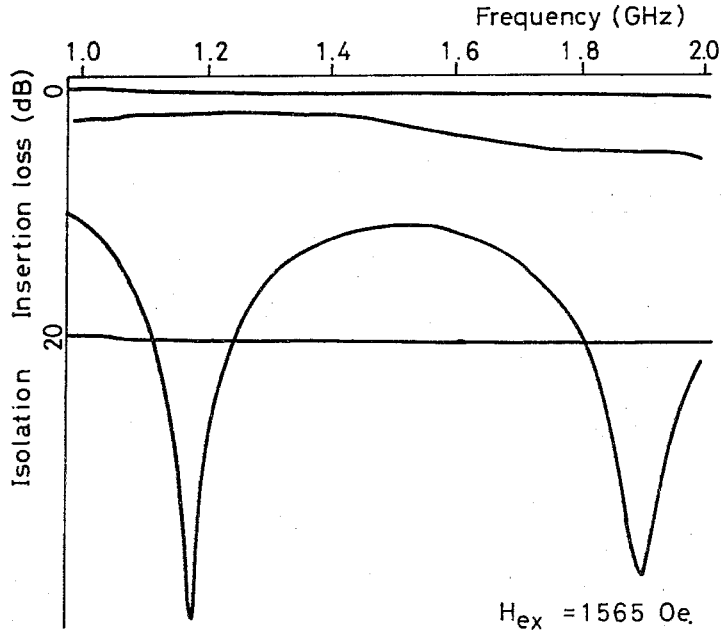

k r2
|k/μ|
Frequency f=3.5(GHz)
H1 (Oe)
mode 2A
mode 2B
mode 2
mode 1A
mode 1B
mode 1
ψ=0.2
ψ=0.4
ψ=0.6
n=*4
n=*3
n=*2
n=*1
n=-1
n=-2
n=-3

ψ Ze/π Zd
|k/μ|
mode 1A
mode 1B
mode 2A
mode 2B
mode 3
mode 1
mode 2
ψ=0.2~0.6
ψ=0.2
ψ=0.6
ψ=0.2 mode 1B
0.2 mode 2B Fig. 18-(a)
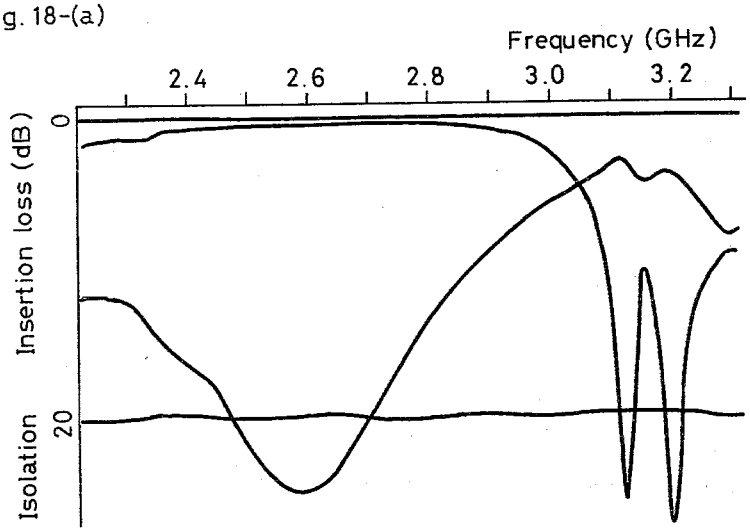
Fig. 18-(b)
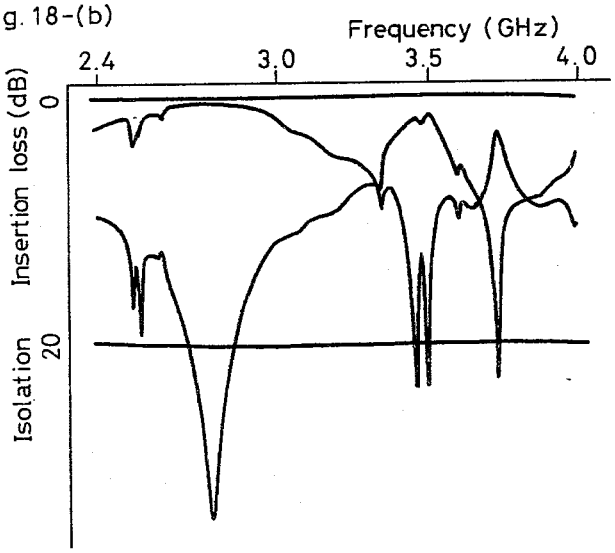

Fig. 23
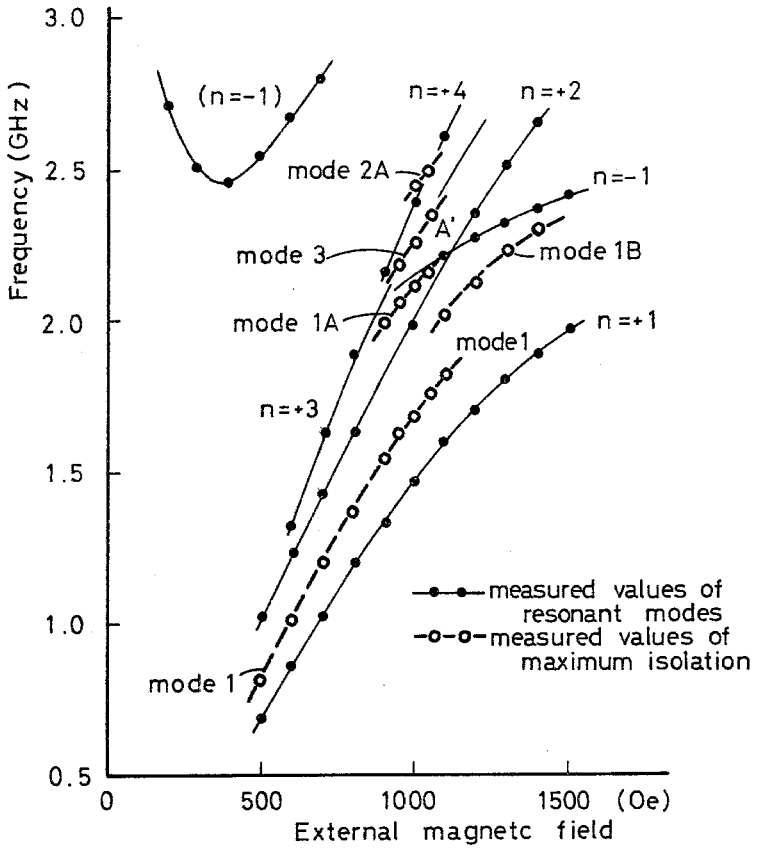
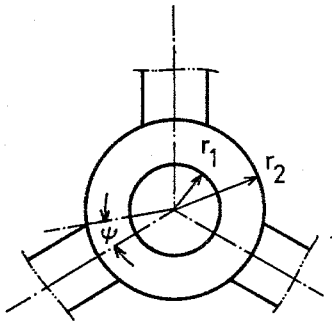
Fig. 24-a
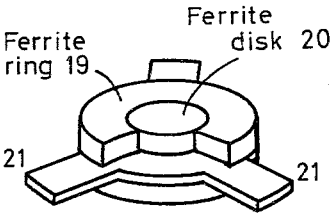
Fig. 24-b

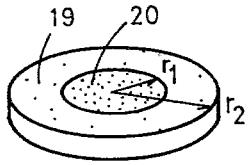
(Fig. 25-a)
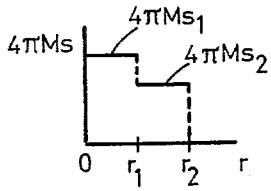
(Fig. 26-a)
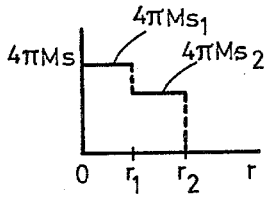
(Fig. 25-b)
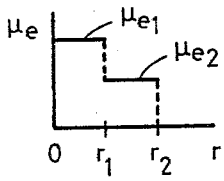
(Fig. 26-b)
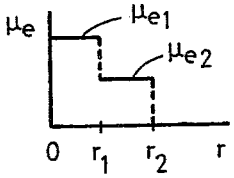
(Fig. 25-c)
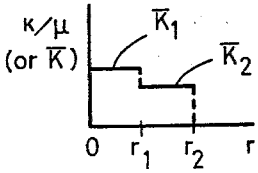
(Fig. 26-c)
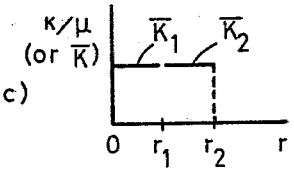
Fig. 27
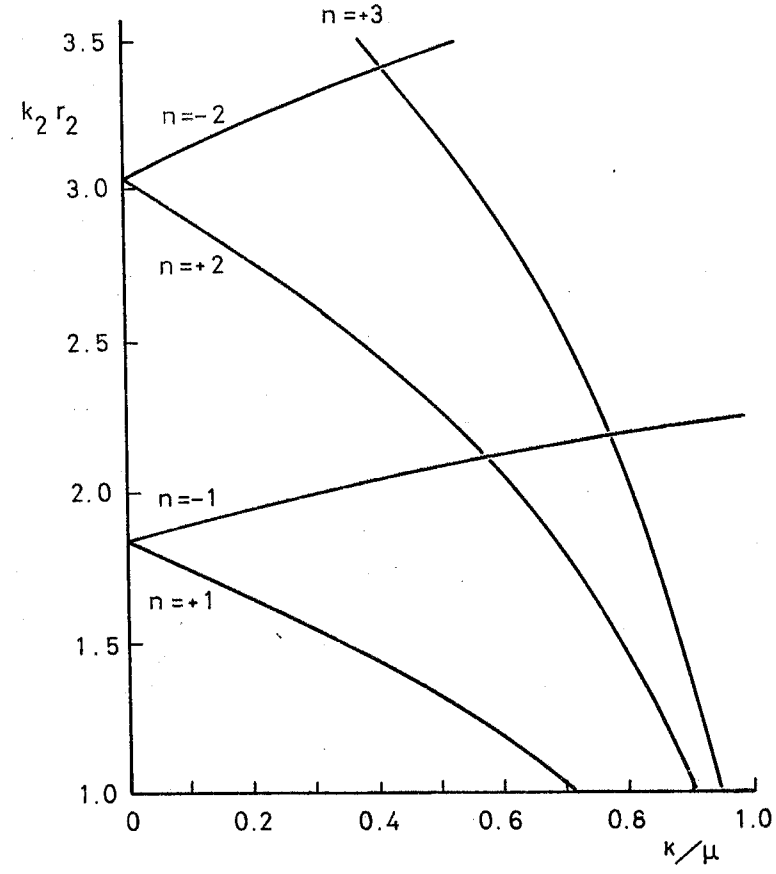
Fig. 27

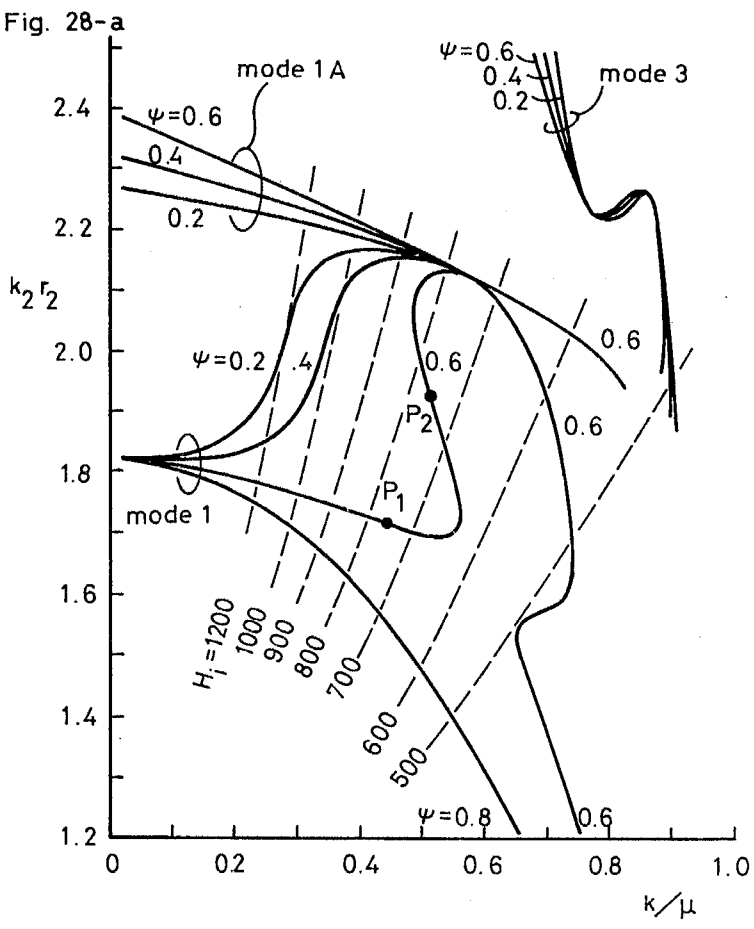
Fig. 28-a
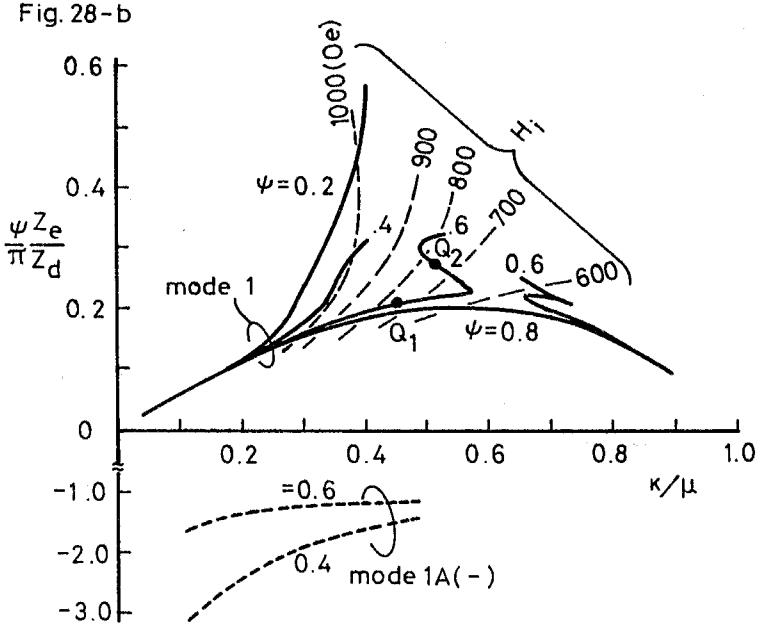
Fig. 28-b
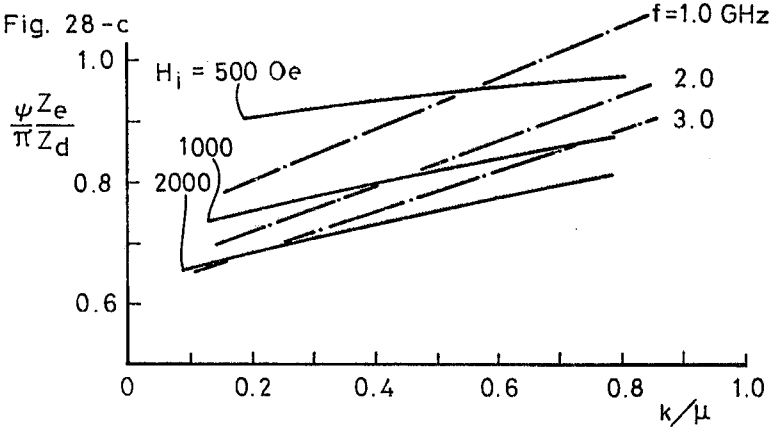
Fig. 28-c

Fig. 29-a
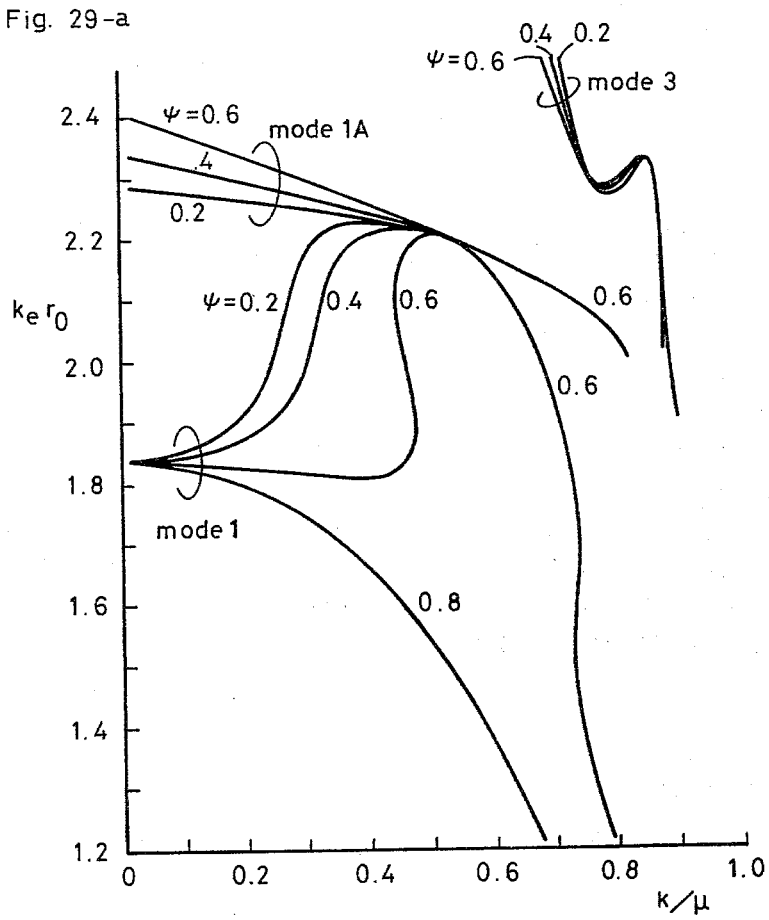
Fig. 29-b
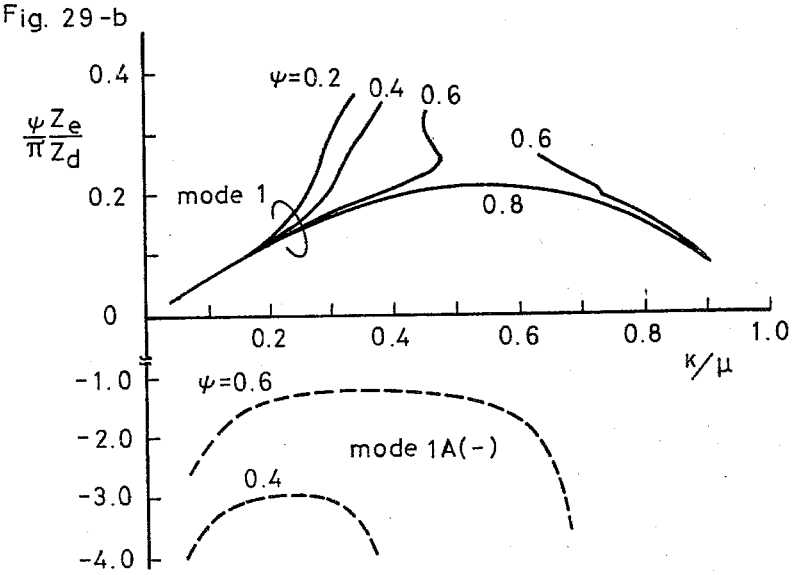

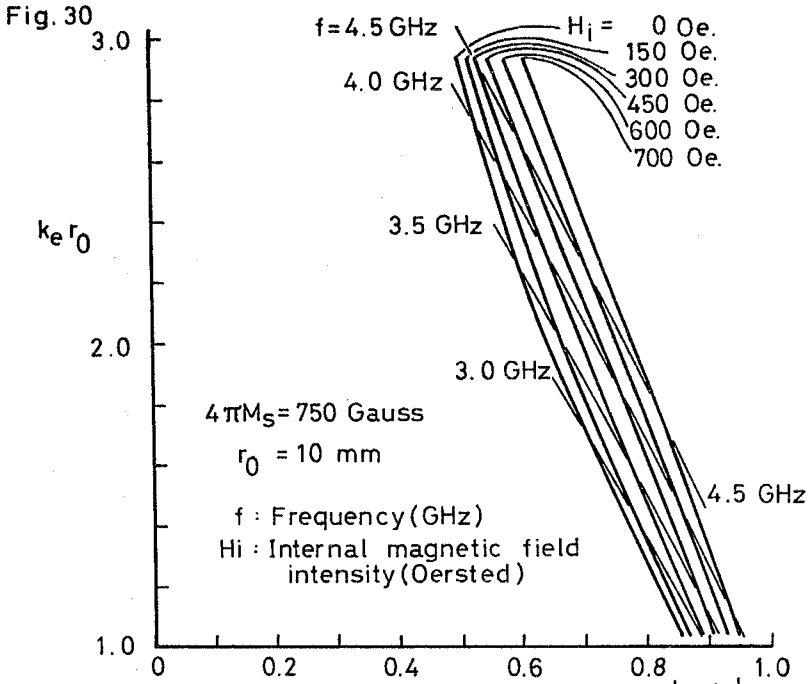
Fig. 30
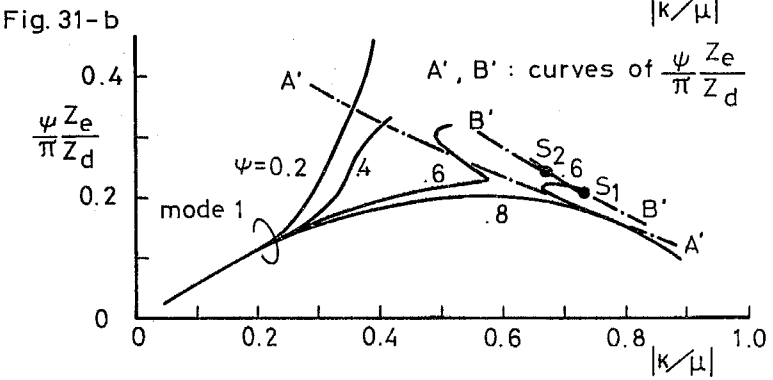
Fig. 31-b
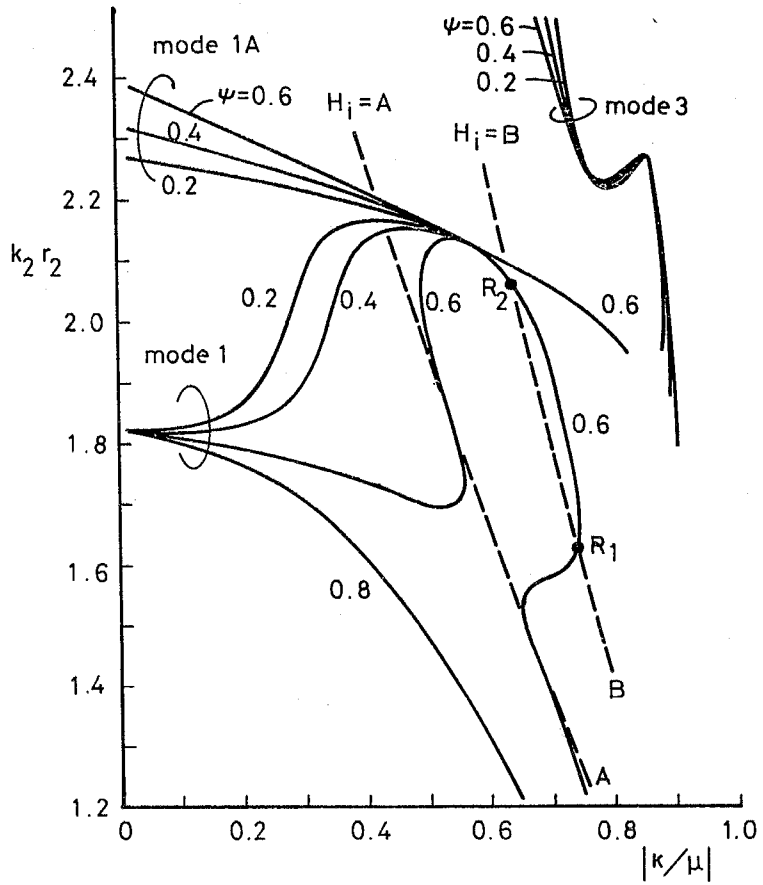
Fig. 31-a

Fig. 32-a
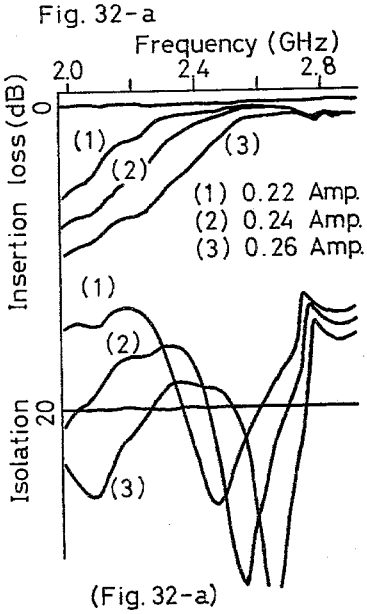
(Fig. 32-a)
Fig. 33
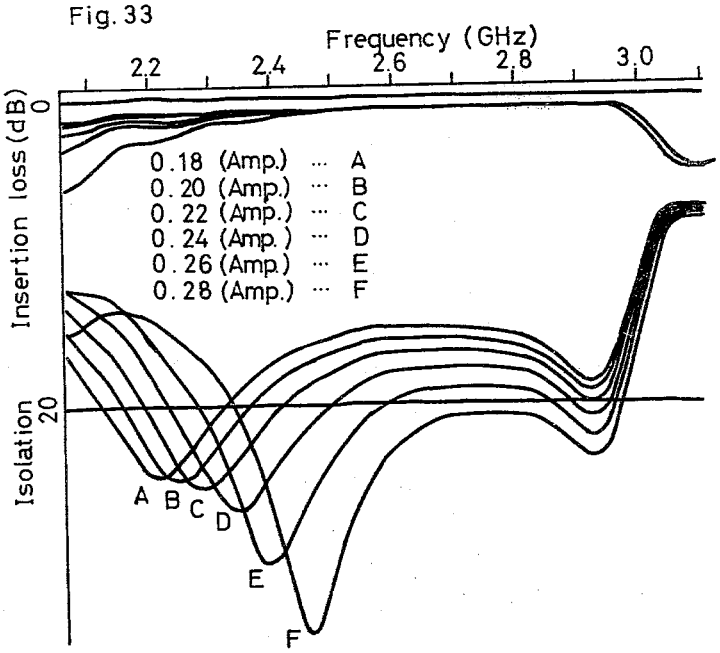
(Fig. 33)
Fig.32-b
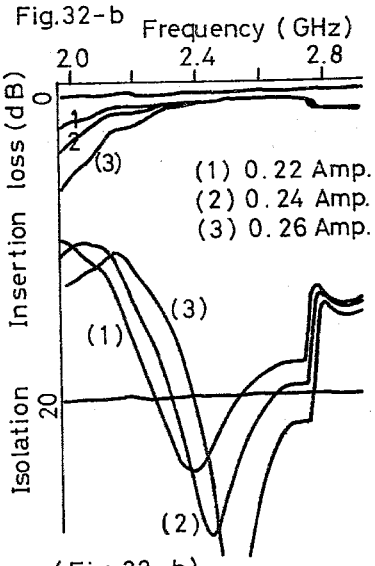
(Fig. 32-b)
Fig. 35
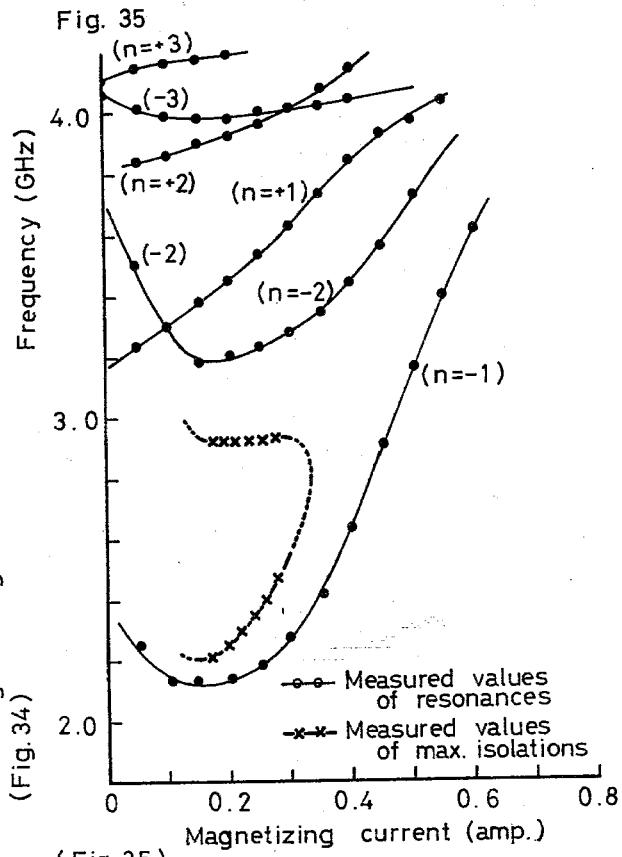
(Fig. 35)
Fig. 34
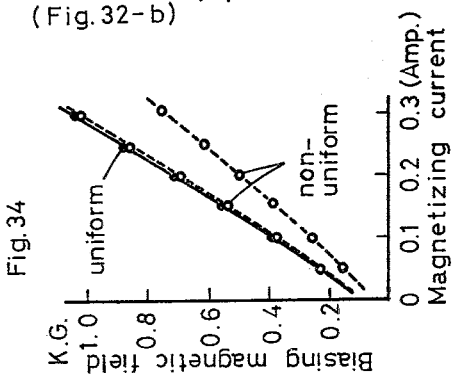
(Fig. 34)

FERRITE COMPOSITE CIRCULATOR

This is a continuation-in-part of my copending application Ser. No. 683,143 filed May 4, 1976 (now U.S. Pat. No. 4,122,418).

BACKGROUND OF THE INVENTION

This invention relates to the findings of multiple circulation frequency operation and broadband operation with various ferrite-composite Y circulators, and improvement and miniaturization of stripline junction circulators, such as Y-junction circulator, X-junction circulator and other multiple-port junction circulators.

The basic stripline Y-junction circulator comprises a pair of ferrite structures, a stripline Y-junction having three stripline branches symmterically extending away from a common region with the same size as that of the ferrite structures attached, and two ground planes covering the device. The biasing magnetic field is applied parallel to a common axis of the ferrite structures.

According to the invention, the ferrite structure acting as nonreciprocal element in the stripline Y circulator is replaced by various ferrite-composite structures. There are three types of ferrite-composite structures, i.e., a ferrite-conductor composite (F/C composite), a ferrite-dielectric-conductor composite (F/D/C composite) and a ferrite-ferrite composite (F/F composite). These ferrite composite structures are made in such a way that constituent elements of a ferrite composite structure are combined, one outside of the other, in the radial direction, to have the last ferrite layer externally encircling the internal portion of the composite.

The electromagnetic fields of the transverse magnetic field mode (the TM mode) are important in these ferrite composite structure, and also in a stripline Y-junction circulator. In the circulator, a ferrite composite structure acts as a coupled resonator through the stripline Y-junction so that resonant TM modes proper to the ferrite composite are coupled one with the other. The circulator action can be, therefore, described in terms of resonant TM modes and coupled TM modes, or rather circulating modes. Generally speaking, circulator action can be represented by circulations at operating points for perfect circulation as has been mentioned in my aforesaid U.S. Pat. No. 4,122,418. The ferrite composite circulators of the invention provide new facets of circulator performances which are represented by multiple circulation frequency operation and its developments, by achieving circulations at two or more operating points of perfect circulation, thus disclosing the way of multiple operating point circulation.

As known in the art of circulators, there are disclosed various types of improved circulators in embodiments of U.S. Pat. Nos. 3,350,663, 3,714,608, 3,851,279, 3,422,375, 3,350,664, and 3,355,679. These prior art circulators commonly utilize the lowest order circulation which consists of the lowest order TM mode among various resonant modes of the ferrite structure, following the way of single operating point performance. Dimensions of a ferrite structure and biasing magnetic field intensity in the design of the prior art circulator closely depend on the lowest-order circulation but not on any other circulations.

One of the prior art circulators accounts for a different version in the way of multiple operating point performance, in that multiple resonances are utilized to get a broadband. It is disclosed in the embodiments of U.S. Pat. No. 3,714,608 (Barnes et al, "Broadband circulator having multiple resonance modes") that the lowest-order circulation having additionally various order resonances in the axial wave propagation produces broadband performance, by introducing multiple resonances so spaced in the frequency spectrum as to get desirable characteristics over a broadband. This art of broadbanding, however, belongs to the category of a single operating point performance from the viewpoint of multiple operating point performance using multiple resonant modes of the radial wave propagation. Insofar as a single operating point performance is used, a narrow band circulator is obtained. Broadbanding of a circulator has long been widely achieved by connecting a broadbanding transformer for impedance matching at each port of the Y-junction. It is effective to get a broadband circulator. However, the gross dimensions of the device become large and symmetric impedance adjustments inevitably result in cost increase. Besides, the design principle of the prior art circulator is not favorable to microwave integrated circuit technology (MIC).

As briefly above-mentioned, the basic principle of circulator action in the circulator of the invention is entirely different from the design principle adopted in the above-described prior art circulators. In the embodiments of the invention, many resonant modes and so many circulating modes, which have been disregarded in the prior art circulators, are positively utilized. Further close discussion on comparison between the prior art circulators and embodiments of the invention will follow after the objects of the present invention is clarified.

An object of the invention is to provide an improved circulator performance, such as broadband operation and variable broadband performance.

A further object of the invention is to provide a new circulator performance, such as diplexer operation or frequency dividing operation.

A still further object of the invention is to provide a ferrite composite circulator of reduced size and weight, favorable to MIC.

Three types of ferrite composites used, i.e., F/C composite, F/D/C composite, and F/F composite, and embodiments of the invention will now be compared in detail with the prior art circulators.

The F/C composite circulator of the invention and the prior art circulators are compared as follows.

(1) Regarding U.S. Pat. No. 3,350,663 (Siekanowicz et al, "Latched ferrite circulator"), it disclosed the ferrite-dielectric-ferrite-conductor combination (the F-D-F-C combination) in the centripetal way in the radial direction in the latched ferrite circulator given in FIG. 6 of their drawings in the above-cited patent. Let the dielectric layer holding the conducting loop be negligibly thin enough as is disclosed, and then the F-D-F-C combination becomes the F-F-C combination which plays a major active role in this latched ferrite circulator. In order to acquire the return path for the magnetic flux flow, two ferrite portions in the F-F-C combination have inversed magnetizations so that clockwise and counter-clockwise rotating field waves of one ferrite do not connect with respective rotating field waves of the other but inverse rotating field waves. Consequently, the totally resonant field modes in the F-F-C combination of the latched ferrite circulator are completely different from those of the F/C composite of the invention. If the dielectric layer is taken into account, the resonant field modes in the F-D-F-C combination become much complicate in comparison with those of the F/C composite. Accordingly, circulating modes and circulations in the latched ferrite circulator will have definitely different characteristics.

(2) Regarding U.S. Pat. No. 3,714,608 (Barnes et al, "Broadband circulator having multiple resonance modes"), it disclosed the ferrite-dielectric-conductor combination (the F-D-C combination) in the centripetal way in the transverse section as an active element in the embodiments given in FIGS. 1, 3, 4, 5, 6, and 8 of their drawings. The most important is that no matter how thick the dielectric layer between the ferrite cylinder and conductive pin may be, and no matter how thick the conductive pin may be, the structure of the F-D-C combination acts as a wave-transmission-line resonator in the axial direction. The active element is designed to support the axial wave propagation having the lowest resonance in the radial direction, from which the broadbanding effect is induced. Contrarily, the F/C composite of the invention is too thin to support any resonance of such axial wave propagation, and the composite does not produce any axial wave propagation.

(3) U.S. Pat. No. 3,851,279 (Andrikian, "Tee junction Waveguide circulator having dielectric matching posts at junction") disclosed the ferrite-dielectric-conductor combination (F-D-C combination) in the axial direction of the device. The combination of this kind does not influence resonant characteristics of the TM modes, because the TM mode is only determined by the condition of a magnetically short-circuited edge (the magnetic wall) at the periphery of the ferrite portion. Dielectric and conductor portions play different roles in circulator adjustments, particularly in impedance matching. The conductive platform has a role to decrease the junction impedance of the waveguide junction, and the dielectric layer has a role to match the intrinsic wave impedance of the ferrite to the waveguide impedance. After all, each of them acts as one of impedance matching transformers.

(4) U.S. Pat. No. 3,422,375 (Omori, "Microwave power dividing network") disclosed a embodiment of a microwave power divider which consisted of a stripline X-junction having a circular common region larger than the radius of the ferrite structure, and a pair of the same F/C composite of the present invention. It is marked that the power divider operates at the intersection of resonant mode curves $TM_{010}$ (n=0.1) and $TM_{110}^-$ (n=−1) in the region below resonance, or could operate at the intersection of resonant mode curves $TM_{010}$ (n=0.1) and $TM_{110}^+$ (n=+1) in the region above resonance, where numbers in parentheses denote the notations of modes given by Bosma ("On stripline Y-circulation in UHF," IEEE Trans. on Microwave Theory and Tech., vol. MTT-12, pp. 61–72, January 1964; FIG. 4, p. 67). The operating region shown in FIG. 2 of their drawings apparently indicates the operation below resonance. The operating range of the power divider is considered to be in the resonant mode curves given by the relation of radial wave propagation constant-radius product $k_e r_0$ versus ferrite anisotropic splitting factor $\kappa/\mu$ the range where resonant mode curves n=0.1, +1, +2, and others of positive orders get together at the point of $k_e r_0=0$ and $\kappa/\mu=1.0$ in the region above resonance, and contrarily, where resonant curves n=0.1, −1, −2, and others of negative orders get together at the point of $k_e r_0=0$ and $|\kappa/\mu|=1.0$, as shown in FIG. 3 of the drawings of the present invention. Furthermore, the operating range is easily identified in the mode chart which is given by the relationship of biasing magnetic field intensity and frequency as schematically shown in FIG. 4 of the drawings of the invention. It is found that the operating range above resonance is located at the lowest biasing magnetic field intensity in the lowest frequencies in the neighborhood of ferromagnetic resonance absorption in the region above resonance, while the operating range below resonance is located at the lowest frequency of the resonant mode n=−1, with such a specific intensity of biasing magnetic field that the specific effective permeability of the ferrite $\mu_e$ becomes zero and the anisotropic splitting factor $\kappa/\mu$ becomes negative unity, which is derived from Polder's equations of tensor permeability of the ferrite (Polder, "On the theory of ferromagnetic resonance," Phil. Mag., vol. 40, pp. 99–115, January 1949). Consequently, the radial wave propagation constant $k_e$ at the operating range is almost nearly zero, and becomes imaginary if the ferrite structure is biased magnetically exceeding the operating range, as the electromagnetic field energy dissipating. Anyway, the operating range is adjusted in such way.

However, with the specific biasing magnetic field intensity pertaining to the operating range below resonance, other higher-order resonant modes taking place in higher frequencies as seen in FIG. 4 of the invention will come into the operation of the power dividing even if these modes are out of resonance, thereby the desirable power dividing operation deteriorating. To secure the power dividing operation, the stripline X-junction, with such large common region as to have its rim exceed the diameter of the ferrite structure, acts to make the two resonant modes, $TM_{010}$ and $TM_{110}^-$, dominate and to suppress other higher-order resonant modes. With this oversized common region of the X-junction, the $TM_{010}$ mode is enforced to have the em fields equal to those of the $TM_{110}^-$ mode, so as to produce a power dividing operation.

In other words, as is disclosed in Column 3, line 16 in the cited patent, "the diameter of post 20 should have such a ratio to the diameter of the common portion of spider 12 that the loaded Q's of the two modes are equal. With equal Q's, power applied to any of the ports will divide equally between the $TM_{110}^-$ and $TM_{010}$ modes." However, though it says in Column 2, lines 56 that post 20 has a diameter that is in the order of three tenths to six tenths of the diameter of the common portion of spider 12, the ratio of the diameter of the common portion of spider and the diameter of the ferrite structure, besides the ratio of the diameter of the common portion of spider and the diameter of the conductive post, should have importance. The former ratio for the ferrite structure is not clearly mentioned. Insofar as the power divider is concerned, the stripline X-junction having an oversized common region is used. Thus, the common region of the X-junction in conjunction with the conductive post of the F/C composite has a unique effect on the power dividing operation in the Omori's way of operation.

As for a stripline X-junction circulator, for the sake of comparison, it consists of a stripline X-junction and a pair of F/C composites loaded therein. The stripline X-junction is designed to have a common region of the same diameter as that of the F/C composite. If the X-junction has an oversized common region, not only the lowest-order circulation but also higher-order circulations will be deteriorated and merely a power dividing operation will take place. As to the X circulator, a stripline X-junction having a common region of the same size as a F/C composite is therefore effective to perform multiple circulation frequency operation.

The F/D/C composite circulator of the invention and the prior art circulators are compared as follows.

(1) U.S. Pat. No. 3,350,663 (Siekanowicz et al, "Latched ferrite circulators") disclosed various combinations among ferrite, dielectric, and conductor in the embodiments of the latched ferrite circulator as shown in FIGS. 6, 11, and 13 of their drawings. The embodiments disclosed in the FIGS. 6 and 11 give the examples of the ferrite-dielectric-ferrite-conductor combination (F-D-F-C combination) and the ferrite-dielectric-ferrite-dielectric-conductor combination (F-D-F-D-C combination), respectively, in the radial direction. Essential distinctions which they bear are that each ferrite element in both embodiments of the FIGS. 6 and 11 has inverse magnetization to produce the return path for the biasing magnetic flux flow, thereby inversely connected opposite rotating em fields producing unique resonant field modes and their circulating modes completely differing from those of the invention as early mentioned.

The embodiment illustrated in the FIG. 13 discloses the F-D-C combination in the radial direction which closely resembles the F/D/C composite of the invention. The latched ferrite circulator disclosed in the FIG. 13 is such that iron post 76, iron disk 77, 78 amd ferrite ring 79 produce the return path for magnetizing flux flow; the conducting turn as the magnetizing current loop is positioned in the dielectric; each ferrite and iron assembly, consisting of a ferrite element, iron pieces for the flux return path and the conducting turn, is separated by dielectric spacers from the conductor of the common region of the X- or Y-junction, and two ground planes.

Insofar as the F-D-C combination in the latched ferrite circulator is concerned, resonant field modes of the TM type may be all the same as those of F/D/C composite if inhomogeneous magnetization probably caused by such insufficient magnetizing system used is neglected, and if the influence of the conducting turn is also disregarded.

The F-D-C combined structure, however, is electrically short-circuited at the upper and lower planes by so many severed iron pieces that the em fields inside the F-D-C combined structure will be modified by these sectoral iron pieces which produce resonant characteristics depending on an angle of the sector iron and a gap between two sectors in the angular direction. In the embodiments disclosed in the FIG. 13, the X- or Y-junction are loaded by a pair of the F-D-C combined structures short-circuited with the iron pieces, whether the iron pieces are severed or not. In any case, incident waves at the X- or Y-junction will be divided into two resonators. The one is for the dielectric separators 82, 83, 82', and 83' bounded by iron disks 77, 78, 77', and 78', and conductors of a common region and upper and lower planes of the junction. The other is for the F-D-C combined structure bounded by iron disks 77, 78, 77', and 78'. To achieve perfect circulation with the embodiment consisting of the two resonators, coupling effect between them must be taken into account. The F/D/C composite circulator of the invention does not have any complexity that the latched ferrite circulator bears.

(2) U.S. Pat. No. 3,714,608 (Barnes et al, "Broadband circulator having multiple resonance modes") disclosed the embodiments having the F-D-C combined structures. As early mentioned, the F-D-C combination consists of a ferrite cylinder which has a small hole, a thin spacer, and a conductive thin pin. Each F-D-C combined structure provides a different electrical path length for each counter rotating mode of the lowest order, as counter rotating modes propagate along the F-D-C combination in the axial direction. In a further embodiment, a thin conductive pin is located axially in each ferrite cylinder, which has a different axial length to provide double resonances. According to the disclosure of the cited patent, the active element is designed to support the axial wave propagation having the common lowest-order resonance defined in the radial direction.

The broadbanding is effected by introducing multiple axial resonances so spaced in the frequency spectrum from each other that the characteristics of reflection coefficients versus frequency (or scattering eigenvalues versus frequency) merge to form a continuum of constant slope across the broadband. Provided that the second-order resonance defined in the radial direction is additionally introduced, whether or not the second group of multiple axial resonances can merge to form another constant slope continuum across the broadband is a new problem that is apparently beyond the disclosure of the cited patent.

Contrarily, the F/D/C composite of the invention does not provide any resonance coming from the axial wave propagation and is too thin to support any of such axial wave propagation. Only the resonant modes of the TM type produced in the transverse directions are utilized in the F/D/C composite circulator of the invention.

(3) U.S. Pat. No. 3,851,279 (Andrikian, "Tee junction waveguide circulator having dielectric matching posts at junction") disclosed the F-D-C combination (which may be, strictly speaking, the C-D-F-D-C combiantion) in the axial direction, in which each element of the F-D-C combination is piled up. This combination, however, does not produce any other mode than the resonant TM modes specifically defined by the condition of the magnetic wall at the periphery of the triangular ferrite portion. Conductive and dielectric portions in the F-D-C combination produce impedance matching effect between the symmetric junction wave impedance of the junction and the intrinsic wave impedance of the ferrite portion. The Tee junction is unsymmetric so that it needs transformation for impedance matching between the symmetric ferrite combined structure and the unsymmetric Tee junction. The dielectric posts are used for that purpose. From these considerations and as is early mentioned, the F-D-C combination in the axial direction in the embodiment disclosed in the cited patent has the same resonant modes as the triangular ferrite has. Therefore, if a disk ferrite is compared to the triangular ferrite, the F/D/C composite has no counter part.

The F/F composite circulator of the invention and the prior art circulator are compared as follows.

(1) U.S. Pat. No. 3,350,663 (Siekanowicz et al, "Latched ferrite circulator") disclosed the F-F combination in the embodiments of the latched ferrite circulator. As is disclosed in the embodiment, it says that all ferrite elements may be of the same ferrite or they may be of different ferrites, in order to provide the return path for the magnetic flux flow, with the cross section area adjusted for continuity of the flux flow. The F-F combination in the latched ferrite circulator is considered to retain a common feature with the different ferrite structure in which a set of different ferrites is incorporated for the ferrite elements in the F-F combination. Each ferrite element is separated by a dielectric holding a magnetizing loop in the F-F combination. A ferrite element inside the dielectric is magnetized inverse to the one outside it for the purpose of the flux return path. Therefore, clockwise and counterclockwise rotating fields in one ferrite element inversely connect with counterclockwise and clockwise rotating fields in the other element. Contrarily, the F/F composite is unidirectionally magnetized so that opposite rotating fields in one ferrite element are connected correspondingly to those in the other ferrite element. Consequently, the F-F combination in the latched ferrite circulator has a role for a flux return path that the F/F composite does not necessitate, and definitely different resonant modal characteristics from those of the F/F composite. These comparisions lead to a conclusion that the latched ferrite circulator is completely different from the F/F composite circulator.

SUMMARY OF THE INVENTION

In accordance with the present invention, it is thus proposed to provide stripline junction circulators performing various circulator actions with ferrite composites in which resonant TM modes and relevant circulating modes are utilized in multiple. Circulator performances are categorized into broadband operation, frequency dividing operation, and others, from the viewpoint of multiple circulation frequency operation. These operations have a common basis on the finding of multiple circulation frequency operation which has been achieved with an F/D composite circulator. Three types of ferrite composites used are F/C composite, F/D/C composite, and F/F composite. In connection with multiple circulation frequency operation, an F/D composite circulator is discussed to provide the basement of these various circulator performances. Other operations with these composites are disclosed. Finally, miniaturization of a ferrite composite circulator is proposed.

BRIEF DESCRIPTION OF THE DRAWINGS

FIG. 1 shows three types of ferrite composites, (a) F/D composite, (b) F/C composite, and (c) F/D/C composite. The biasing magnetic field is applied parallet to a common axis of rotational symmetry in a composite structure.

FIG. 2 shows (a) a ferrite composite resonator consisting of a pair of ferrite composites (18) and a junction having one port 14, and (b) a ferrite composite Y circulator consisting of a stripline Y-junction 15, a pair of ferrite composites (18) and a stripline Y-junction 15. Two ground planes 16 and 17 cover the core region of the device but is not shown in FIG. 2-*a*.

FIG. 3 shows the typical relationship between radial wave propagation constant-radius product ($k_e r_0$) versus ferrite anisotropic splitting factor $\kappa/\mu$ for both cases (a) above resonance and (b) below resonance. These results for resonant TM modes are obtained for the case of a disk ferrite resonator.

FIG. 6 shows stationary and rotating patterns, and their product according to each point denoted by letters A through F. The resultant pattern as a product of these patterns indicated only a special case in a positive-sense circulation. An arrow on each rotating pattern denotes the direction of rotation. #1, #2, and #3 denote three ports of the Y-junction.

FIG. 7 shows resonant mode curves for an F/D composite as a function of specific effective permeability $\mu_e$ and radius ratio $r_1/r_2$.

FIG. 10 demonstrates the principle of circulation adjustments for double circulation frequency operation.

FIG. 10(*a*) shows schematically computed results for the first circulation condition in which operating points given by intersections between the first conditional curves and a given internal magnetic field locus are indicated, and FIG. 10(*b*) exemplifies the adjustment of the second circulation condition with respect to the operating points.

FIG. 11 shows performance examples of (a) multiple circulation frequency operation and (b) double circulation frequency operation. (a) shows variation of the performance in sequential change of the biasing magnetic field intensity and (b) shows an example of the double circulation frequency operation when the F/D composite is surrounded by a dielectric layer of specific permittivity $\epsilon_d=10$ and the width of 10 mm.

FIG. 18 demonstrates performance examples of diplexer operation. (a) is the case that circulations of modes 1A, 2A and 2B take place. (b) is the case that circulations of modes 1B, 2A, and 2B take place, with another higher-order circulation taking place.

FIGS. 22-(*a*) through (*d*) are obtained with sequential change of biasing magnetic field. (a) shows a double circulation frequency operation. (d) shows the operation in which four circulations take place. The upper curve of each figure is for insertion loss and the lower curve is for isolation.

FIG. 23 is the mode chart for the case of an F/D/C composite Y circulator which is obtained partly from the performances shown in FIG. 22.

FIG. 24 shows (a) the geometrical configuration and (b) a view of the core portion of an F/F composite Y circulator. Two ground planes are not shown.

FIG. 25 shows (a) the profile of saturation magnetization $4\pi M_s$, (b) the profile of specific effective permeability $\mu_e$, and (c) the profile of ferrite anisotropic splitting factor $\kappa/\mu$, all in the radial direction inside an F/F composite, under a uniform biasing magnetic field.

FIG. 26 shows (a) the profile of saturation magnetization $4\pi M_s$, (b) the profile of specific effective permeability $\mu_e$, and (c) the profile of anisotropic splitting factor $\kappa/\mu$, all in the radial direction inside an F/F composite, with the condition of a constant $\kappa/\mu$, under a nonuniform biasing magnetic field.

FIG. 27 shows resonant mode curves of an F/F composite, with a nonuniform magnetic field to attain the condition of a flat profile of $\kappa/\mu$, and with such parameters that $4\pi M_{s1}=1200$ Gauss, $\epsilon_1=14.5$, $4\pi M_{s2}=750$ Gauss, $\epsilon_2=14.5$, $r_1/r_2=0.45$, and $r_2=10$ mm.

FIGS. 28-(*a*) through (*c*) show three conditional curves; the first circulation conditional curves for the case of the F/F composite Y circulator, having the same parameters that are given in FIG. 27; the second circulation conditional curves computed from the right-hand term of the second conditional equation, corresponding to the first circulation conditional curves; the relationship of $(\psi/\pi)(Z_e/Z_d)$ against $\kappa/\mu$ which is computed from the left-hand term of the second conditional equation, where only the case of $\psi=0.6$ is shown.

FIGS. 29-(*a*) and (*b*) show the first and second circulation conditional curves, respectively, for the case of a disk-ferrite circulator, with the parameters that $4\pi M_s=750$ Gauss, $\epsilon_e=14.5$, and $r_o=10$ mm.

FIG. 30 shows computed results of radial wave propagation constant-radius product $k_e r_o$ versus anisotropic splitting factor $\kappa/\mu$ relationship regarding a disk ferrite, in the region below resonance within the positive internal magnetic field range.

FIG. 31 shows (a) possible operating range of a F/F composite Y circulator that are indicated in the first circulation conditional curves, in the region below resonance, and (b) the requirement necessary for circulation adjustments at possible operating ranges, A' and B', which correspond to A and B, respectively, in FIG. 31-(*a*).

FIGS. 32-(*a*) and (*b*) show circulator performances obtained under the uniform and nonuniform biasing magnetic fields, respectively, in the region below resonance.

FIG. 33 demonstrates improved performances with the nonuniform biasing magnetic field. Each curve indicated by letters A through F is obtained at different magnetic intensities.

FIG. 34 gives the relationships of field strength against magnetizing current for both cases of uniform and nonuniform biasing magnetic fields. The nonuniform biasing magnetic field is measured at the center and periphery of the F/F composite.

FIG. 35 shows the mode chart in which measured frequencies of maximum isolations are superimposed.

DETAILED DESCRIPTION OF THE INVENTION

I. General Description

Figure 4:
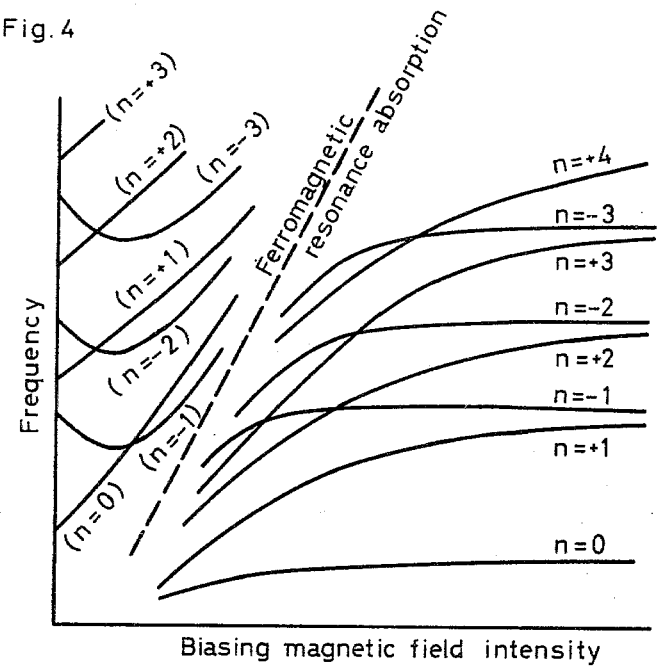
FIG. 4 is a mode chart that is conceptionally drawn according to resonant mode curves given in FIG. 3. Numbers shown correspond to those denoted in FIG. 3.

In the beginning, the definitions of resonant modes in a ferrite composite resonator and modes of perfect circulation in a stripline Y-junction loaded with the composite resonator are presented. Specific descriptions on various performances with stripline Y-junctions loaded with ferrite composite resonators of the invention will follow thereinafter.

A disk ferrite is usually utilized in a prior art circulator. Three types of ferrite composites are utilized in a stripline Y circulator in the embodiment of the invention. They are ferrite-conductor composite (F/C composite), ferrite-dielectric-conductor composite (F/D/C composite) and ferrite-ferrite composite (F/F composite). One more type of a ferrite composite, i.e., ferrite-dielectric composite (F/D composite), is added to these types, for providing a common basis of circulator action in the embodiments of the invention, and also for comparing with the prior art disk-ferrite circulator.

As has been disclosed in my aforesaid U.S. Pat. No. 4,122,418, these composites are prepared in common by combining an annular ferrite 11 with a circular dielectric 10, or a center conductor 12, or an annular dielectric 13 with a center conductor 12 substituted therein, in such a way that the annular ferrite 11 encircles the other elements inserted therein to form a disk configuration with a common thickness, as shown in FIG. 1. An F/D composite of the first type consists of an annular ferrite having the radius $r_2$, the ratio of inner and outer radii $r_1/r_2$ and a common thickness h', and circular dielectric having the radius $r_1$ and the common thickness h', as shown in FIG. 1-*a*. The thickness of the F/D composite is usually chosen in the range of $h'/r_2<0.3$. An F/C composite for the second type consists of an annular ferrite having the same geometry as that of the ferrite portion of the F/D composite, and a center conductor 12 which is placed in the interior of the annular ferrite as shown in FIG. 1-*b*, and which has a common thickness at its full length. An F/D/C composite for the third type consists of an annular ferrite 11 having the radius $r_3$, the inner-to-outer radius ratio $r_2/r_3$ and a common thickness h', an annular dielectric 13 having the radius $r_2$, the inner-to-outer radius ratio $r_1/r_3$ and the common thickness h', and a center conductor 12 with the common thickness h' at its full length, as shown in FIG. 1-*c*. The thickness of the F/D/C composite is normally chosen in the range of $h'/r_3<0.3$ to hold the uniformity of magnetization inside the ferrite portion.

A composite resonator is an embodiment which comprises a pair of the composites 18, a center conductor 14 placed between the composites, and two ground planes covering the upper and lower sides of the embodiment. The center conductor has the same radius as that of the composite used and the thickness t, being chosen thin enough in comparison with the thickness of the composite h', and has one port. A stripline Y-junction 15 has three stripline branches symmetrically extending away from a common region. The stripline Y-junction in a circulator is loaded with composites. The biasing magnetic field $H_{dc}$ is applied normally to the plane of the composite, as shown in FIG. 2.

Electromagnetic fields in the composite are considered, similar to those in a disk ferrite, as such that the electric field has only a z-component $E_z$ and the magnetic field has the radial and angular components $H_r$ and $H_\theta$, these components being independent of the z-coordinate in cylindrical coordinates (r, $\theta$, z). The above-mentioned requirement on the em fields in the composite is satisfied if the composite is thin enough in comparison with the wave length and also the spacing between the center conductor and the ground plane is very narrow as well as in the case of the disk ferrite circulator.

It is generally acknowledged that em field modes which are defined by the condition of a magnetically short-circuited edge (the magnetic wall) at the periphery of the ferrite region of the composite play essential roles in circulator action. Actually, the em field modes are determined by the vanishing condition of the angular magnetic field $H_\theta$ at the outside boundary of the ferrite portion of the composite, which are called transverse magnetic field modes (the TM modes). The TM modes are dependent on the wave propagation of the em fields in the radial and angular directions in the transverse plane including the composite, and independent of the z-coordinate parallel to a common axis of symmetry of the composite because of no axial wave propagation of the em fields. To secure no axial wave propagation, the thickness of the composite h' must be less than a quarter wavelength, that is, $h' < (\lambda_0/4)/\sqrt{\epsilon_e}$, where $\lambda_0$ is the wavelength in vacuum and $\epsilon_e$ is the specific permittivity of the ferrite material used.

The TM modes without any z-dependence contain infinite numbers of resonances, and are classified in such a way that the minimum roots of the n-th order of resonant modes for no, clockwise, and counterclockwise rotations which are computed from $H_{\theta n}=0$, give the first radial wave propagation constants, and the next minimum roots give the second wave propagation constants of the same order.

Notation of TM modes is given in comparison with the usual nomenclature which is shown in parentheses as follows,

| | |
|---|---|
| n = 0.1, | ($TM_{100}$) |
| n = +1.1, and −1.1, | ($TM^{+}_{110}$ and $TM^{-}_{110}$), |
| n = +2.1, and −2.1, | ($TM^{+}_{120}$ and $TM^{-}_{120}$), |
| n = +3.1, and −3.1, | ($TM^{+}_{130}$ and $TM^{-}_{130}$), |
| n = +4.1, and −4.1, | ($TM^{+}_{140}$ and $TM^{-}_{140}$), etc., |

where no plus, and minus signs, respectively, denote no, clockwise, and counterclockwise-rotating modes, the first and second numbers refer to the order of resonance and the minimum root of a mode pair, respectively, and also three numbers in subscript in parentheses denote the orders of radial, angular and z-directions of resonance, respectively. The minimum roots of each order of resonance is important.

These resonant TM modes are characterized in the relationship of radial wave propagation constant-radius product ($k_e r_0$ for a disk ferrite, $k_e r_2$ for a F/C composite, $k_2 r_2$ for a F/D or F/F composite, and $k_2 r_3$ for a F/D/C composite) against anisotropic splitting $\kappa/\mu$ as shown in FIG. 3. If the biasing magnetic field is changed from above resonance to below resonance, the direction of rotation of each resonant mode is reversed since $\kappa/\mu$ changes in sign and becomes negative in the region below resonance. To know what kind of resonance takes place at a given biasing magnetic field, Loci of constant internal magnetic field intensity are drawn superimposed in resonant mode curves as shown in FIG. 3. Polder's equations of tensor permeability (Polder, "On the theory of ferromagnetic resonance," Phil. Mag., vol. 40, pp. 99–115, January 1949) are used in computation to get such loci in the region above resonance and partially in the region below resonance. Green and Sandy's equations (Green and Sandy, "Microwave characterization of partially magnetized ferrite," IEEE Trans. on Microwave Theory and Techniques, vol. MTT-22, pp. 641–645, June 1974) are used in the remainder of the region below resonance. Loci of constant magnetization instead are obtained within a narrowly limited region which is not marked in FIG. 3-*b*.

A mode chart is contrasted with resonant mode curves. The mode chart can be obtained by measuring resonant frequencies of a composite resonator in sequential change of biasing magnetic field intensity. The mode chart is shown schematically in FIG. 4. Resonant mode curves below resonance exist in the region for higher frequencies and lower biasing magnetic field intensities, and are upper-bounded by ferromagnetic resonance absorption in increasing the magnetic field. Contrarily, resonant mode curves above resonance exist in the region for lower frequencies and higher magnetic field intensities, and are lower-bounded by ferromagnetic resonance absorption in decreasing the magnetic field.

Generally speaking, circulator action can be described in terms of circulating modes which is defined in the first circulation conditional curves in comparison with resonant mode curves. The first conditional curves, as a function of $\psi$ half the coupling angle subtending the stripline width at the center conductor, are obtained by computing the first conditional equation of perfect circulation given by Eq. (8) in my aforesaid U.S. Pat. No. 4,122,418. Numbers of resonant modes retained in computation are dependent upon the operating range of circulation. Insofar as the lowest-order circulation, mode 1, is concerned, the numbers of order up to n=4 will be enough. If higher-order circulations than mode 1 are important, then more numbers of the order of resonant modes must be retained in computation. For example, m=+2 and m=−2 in Eq. (4) in my aforesaid U.S. Pat. No. 4,122,418 show the case that numbers of the order of resonant modes up to n=6 are retained.

Figure 5:
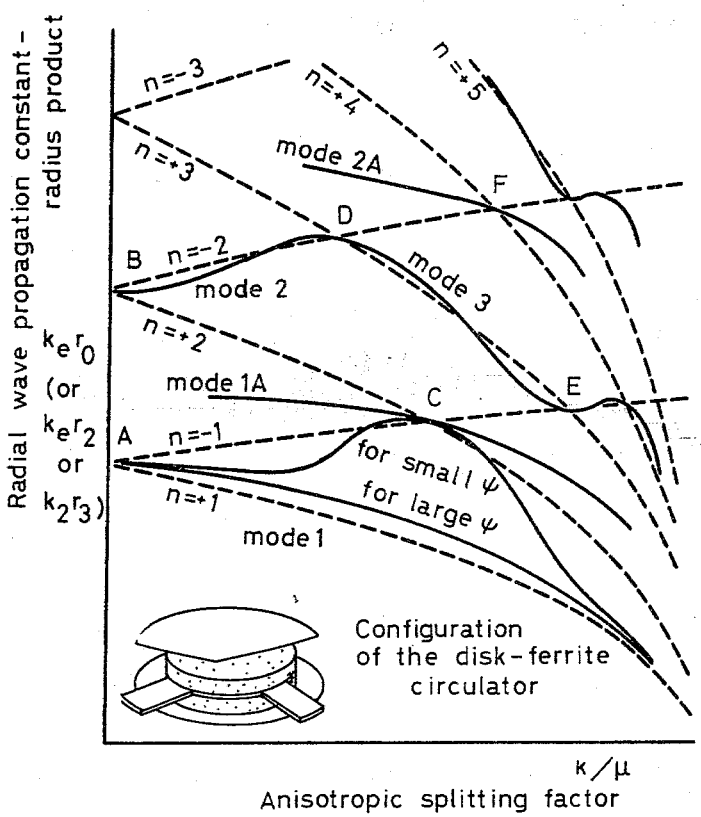
FIG. 5 shows the relationship between resonant mode curves and the first circulation conditional curves, in which the definition of circulating modes in the disk-ferrite circulator is given.

Definition of circulating modes are presented in FIG. 5. Labeling of circulating modes comes from the notation given by Davies and Cohen (Davies and Cohen, "Theoretical design of symmetrical junction stripline circulator," IEEE Trans. on Microwave Theory and Techniques, vol. MTT-11, pp. 506–512, November 1963).

The first conditional curves of mode 1 (mode 1 curves) for small $\psi$ go from the degenerate point of resonant modes $n=+1$ and $-1$, where the curves of $n=+1$ and $-1$ join at the values of $\kappa/\mu=0$, through intersection of resonant curves $n=-1$ and $+2$, while mode 1 curves for large $\psi$ run almost coincidentally along the resonant curve $n=+1$. Mode 1B curves for small $\psi$ split from mode 1 curve will small $\psi$ when a composite, for example, F/C, or F/D/C composite, is utilized, whereas mode 1B curves for large $\psi$ appear in the counter region at an obtuse angle made by the resonant curves $n=-1$ and $+2$. Mode 1A curves appear only in the region at an acute angle between the resonant curves $n=-1$ and $+2$. Curves of modes 1, 1A, and 1B do not intersect. Mode 2 curves go from the degenerate point of resonant modes $n=+2$ and $-2$, where they joint at $\kappa/\mu=0$, passing through intersections, in turn, of resonant curves, $n=-1$ and $+3$, $n=-1$ and $+3$, $n=-1$ and $+4$, and so on. Davies and Cohen labeled one of mode 2 seriate as mode 3. Mode 2A curves pass intersection of resonant curves $n=-2$ and $+4$, lying in the region of an acute angle between the curves $n=-2$ and $+4$. Mode 2B curves lie in the neighborhood of mode 2A.

Circulations at various points denoted by letters A through F as shown in FIG. 5 are now discussed.

Circulations of mode 1 and mode 2 have ever been studied by Bosma (Bosma, "On stripline Y-circulation at UHF," IEEE Trans. on Microwave Theory and Tech., vol. MTT-12, pp. 61–72, January 1964) and Fay and Comstock (Fay and Comstock, "Operation of the ferrite junction circulator," IEEE Trans. on Microwave Theory and Tech., vol. MTT-13, pp. 15–27, January 1965). Mode 1 circulation at A is an operation in which resonant modes $n=+1$ and $-1$ play important roles, in such a way that they produce the standing wave pattern of the dipolar magnetic field mode in the circumference of the ferrite structure, and the circulation takes place when the dipolar pattern is rotated by an angle of 30° at the input port. Mode 2 circulation at B is an operation in which resonant modes $n=+2$ and $-2$ produce the standing wave pattern of the quadrupolar magnetic field mode in the circumference of the ferrite structure, and the circulation takes place when the quadrupolar pattern is rotated by an angle of 15° at the input port. Circulations of modes 1 and 2 having the standing wave pattern are of a particular case.

In general, other circulations at C through F have no standing wave pattern but a non-standing wave pattern that is given by product of stationary and rotating patterns produced by constituent resonant modes in the circumference of the ferrite structure.

Constituent resonant modes, stationary and rotating patterns, and their product pattern at each operating point from A to F are shown in FIG. 6, where a resultant product pattern given in the far right-hand column shows a special case in circulation.

Modes 1A and 1B have commonly a stationary pattern with three poles in the circumference of the ferrite structure since they have six poles over $4\pi$ radians and therefore they hold three poles doubled over $2\pi$ radians. The rotating pattern of mode 1A has one pole over $2\pi$ radians since it has two poles over $4\pi$ radians during the period of two revolution per cycle. Contrastly, mode 1B has a monopolar standing-wavelike pattern made by two oppositely rotating one-pole pattern produced by two pairs of resonant modes, $n=-1$ and $+2$, and $n=+1$ and $-2$. The same is the case with modes 2A and 2B.

Modes 2A and 2B have commonly a stationary pattern with six poles, every other pole of which agrees to three ports of the Y-junction. The rotating pattern of mode 2A has one revolution per cycle, so that it takes the dipolar pattern. Mode 2B mainly consists of two pairs of resonant modes $n=-2$ and $+4$, and $n=+2$ and $-4$, and therefore two opposite rotating patterns produce a dipolar-standing-wave-like pattern. Consequently, as the resultant pattern of mode 2B is product of the six-pole stationary and dipolar standing-wave-like pattern, it becomes a quadrupole-like pattern. As every other pole among six poles of the stationary pattern agrees to each port of the Y-junction, and if the resultant pattern has no contribution to the isolated port, then mode 2B circulation takes place.

Each circulation in multiple circulation frequency operation can be explained in terms of the aforementioned standing and nonstanding wave patterns produced in the circumference of the ferrite structure. In order to perform multiple circulation frequency operation, circulation at each operating point is required to satisfy the perfect circulation condition. This requirement is studied with the assistance of the first and second circulation conditional curves that are closely related with loci of constant internal magnetic field intensities and frequencies. These loci are computed by using the above-cited Polder's equations of tensor permeability and/or the Green and Sandy's equations. The steps to be followed in circulation adjustments to satisfy the requirement are that operating points are determined by intersections between the first circulation conditional curves and one locus of constant internal magnetic field intensity; and the second circulation condition must be satisfied at each operating point by adjusting several factors influencing the junction impedance of the composite and the wave impedance of the coupled stripline. Circulation at each operating point will perform an ideal operation only if the circulation adjustments are completely satisfied. Practically, in multiple circulation frequency operation, if a composite structure and coupled stripline width are once given, operating points are eventually determined along with the biasing magnetic field intensity. After circulation adjustments are achieved, whether or not perfect circulation will take place at each operating point, it depends on the process of impedance matching between input impedance of the Y-junction and the 50-Ω transmission lines coupled to the device.

In this statement, composite circulators in the embodiments of the invention are mostly described in terms of Y circulators of stripline types. However, it is easily extended to X-junction circulator, five-port circulator, six-port circulator, and so on.

II. On performance of F/D composite Y circulators

An F/D composite is prepared by combining a center dielectric disk and a closely fitting ferrite ring into a disk configuration, with a common thickness. An F/D composite Y circulator comprises a pair of F/D composites and a stripline Y-junction having a common region of the same size as that of the F/C composite, as shown in FIG. 2-*b*.

The em fields in the F/D composite are assumed as such that the electric field has only a z-component and that the em fields do not depend on the z-coordinate in cylindrical coordinates (r, $\theta$, z). Specific permittivities of the dielectric disk and the ferrite ring are denoted by $\epsilon_1$ and $\epsilon_2$, respectively, and the specific tensor permeability of the ferrite $[\mu]$ is given by $$[\mu] = \begin{bmatrix} \mu & -j\kappa & 0 \\ j\kappa & \mu & 0 \\ 0 & 0 & \mu_3 \end{bmatrix}. \quad (1)$$

An specific effective permeability $\mu_e$ is given by $$\mu_e = (\mu^2 - \kappa^2)/\mu \quad (2)$$

and the radial wave propagation constant $k_2$ in the ferrite by $$k_2 = \omega\sqrt{\epsilon_0\mu_0\epsilon_2\mu_e}, \quad (3)$$

while the radial wave propagation constant in the dielectric disk by $$k_1 = \omega\sqrt{\epsilon_0\mu_0\epsilon_1}. \quad (4)$$

With these difinitions, and by solving the Maxwell's equations, the electric field can be derived. They are given by $$E_{z1} = \sum_{n=-\infty}^{\infty} a_n J_n(k_1 r) e^{-jn\theta} \quad (5)$$

in the dielectric disk, and $$E_{z2} = \sum_{n=-\infty}^{\infty} b_n\{J_n(k_2 r) + c_n Y_n(k_2 r)\} e^{-jn\theta} \quad (6)$$

in the ferrite ring, where $a_n$, $b_n$ and $c_n$ are coefficients. The radial and angular components of the magnetic field are given by $$H_r(r, \theta) = -j\{\frac{1}{r}\frac{\delta E_z}{\delta\theta} + j\frac{\kappa}{\mu}\frac{\delta E_z}{\delta r}\}/\omega\mu_0\mu_e, \quad (7)$$

$$H(r, \theta) = j\{\frac{\delta E_z}{\delta r} - j\frac{\kappa}{\mu}\frac{1}{r}\frac{\delta E_z}{\delta\theta}\}/\omega\mu_0\mu_e. \quad (8)$$

while in the dielectric disk, those components of the magnetic field are obtained from (7) and (8), by taking $\epsilon_2 \rightarrow \epsilon_1$ and $\kappa \rightarrow 0$. The em fields, both in the dielectric disk and ferrite ring, must satisfy the continuity condition of tangential components of the em fields at the boundary of $r = r_1$. Applying the continuity conditions, one can determine the coefficient $c_n$ in (6). The electric field in the ferrite ring is given by $$E_{z2} = \sum_{n=-\infty}^{\infty} b_n F_n e^{-jn\theta}, \quad (9)$$

$$F_n = J_n(x) + c_n Y_n(x), \quad (10)$$

$$\text{where} \begin{cases} c_n = -\{J_n'(x_2) - J_n(x_2)I_n\}/\{Y_n'(x_2) - Y_n(x_2)I_n\}, \\ I_n = (\eta_1/\eta_2)\{J_n'(x_1)/J_n(x_1)\} + \frac{\kappa}{\mu}\frac{n}{x_2}, \\ \eta_1/\eta_2 = \sqrt{(\epsilon_0\epsilon_1)/\mu_0} \,/\, \sqrt{(\epsilon_0\epsilon_2)/(\mu_0\mu_2)}, \\ x = k_2 r,\ x_1 = k_1 r_1,\ x_2 = k_2 r_1. \end{cases} \quad (11)$$

The TM mode of the composite is determined by the condition of a magnetically short-circuited edge at the periphery of the ferrite ring. The TM mode of the $\nu$-th order is given by $$F_\nu(x_3) - \frac{\kappa}{\mu}\frac{\nu}{x_3}F_\nu(x_3) = 0, \quad (12)$$

where $x_3 = k_2 r_2$ and $\nu$ may be a zero, positive or negative integer. Computed results of (12) in the $k_2 r_2$ versus $\kappa/\mu$ relationship for various modes are shown in FIG. 7, as a function of the ratio $r_1/r_2$ and specific permeability $\mu_e$.

Each resonant mode curves shift upwards, with $\mu_e$ and $r_1/r_2$ increased. It is understood that resonant mode curves in the F/D composite with a given saturation magnetization $4\pi M_s$ change from resonant curves with large values of $\mu_e$ in the large values of $\kappa/\mu$ to resonant curves with small values of $\mu_e$ in the small values of $\kappa/\mu$ in the region above resonance.

The first and second conditional curves of perfect circulation are obtained by computing the first and second conditional equations given by Eqs. (8) and (9) and using the definitions given by Eqs. (2) (or (10) and (11) in this disclosure), (4) and (5) in my aforesaid U.S. Pat. No. 4,122,418, column 3, line 51 to column 4, line 50.

Figures 8, 9:
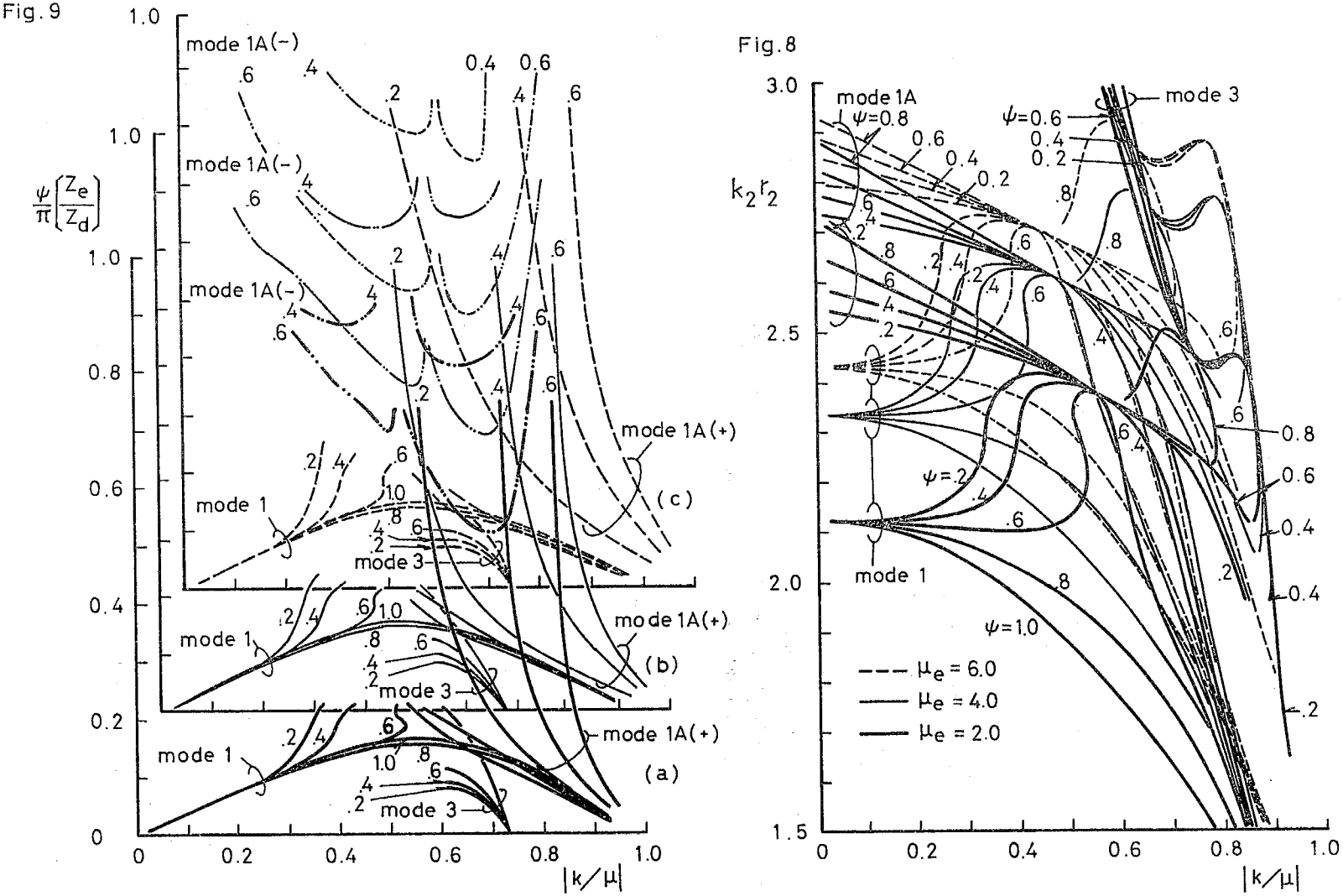
FIG. 8 shows the first circulation conditional curves for the case of the F/D composite Y-junction circulator as a function of specific effective permeability $\mu_e$, with the common ratio $r_1/r_2=0.45$.
FIG. 9 shows the second circulation conditional curves corresponding to the first circulation conditional curves given in FIG. 8.

Computed results for the first circulation condition and the right-hand term of the second circulation conditional equation for the case of $r_1/r_2 = 0.45$ are shown in FIGS. 8 and 9. They are a function of $\mu_e$ instead of saturation magnetization $4\pi M_s$. If $\mu_e$ is increased, each curve of the first conditional curves in FIG. 8 shifts upwards. Therefore, the first conditional curves in the F/D composite circulator with a given saturation magnetization correspond to the curves of large $\mu_e$ in the large values of $\kappa/\mu$, and the curves of small $\mu_e$ in the small values of $\kappa/\mu$ in the region above resonance. The second conditional curves do not present a sharp contrast to the first circulation conditional curves in the $\mu_e$ dependence. It is, however, recognized that the curves of $(\psi/\pi)(Z_e/Z_d)$ for modes 1 and 3 in the large values of $\kappa/\mu$ are depressed, with $\mu_e$ increased.

Multiple circulation frequency operation is extension of double circulation frequency operation (DCFO). Circulation adjustments of DCFO are demonstrated, for convenience. Each operating points of the DCFO is found to take place under one definite internal magnetic field intensity. In other words, operating points can be distinguished from each other in the $k_2 r_2$ versus $\kappa/\mu$ relationship of the first circulation condition on which both constant internal magnetic field loci and constant frequency loci are superimposed. FIG. 10 shows schematically locations of the operating points $P_1$, $P_2$ and $P_3$ of modes 1, 1A and 3, respectively, on the internal magnetic field locus $H_{i1}$. If the magnetic field is increased from $H_{i1}$ to $H_{i2}$, each operating point moves along its mode curve, say, from $P_1$ to $P_1'$, from $P_2$ to $P_2'$, and so on, which depends on $\psi$ the half coupling angle of the stripline. Then, circulation frequencies $f_1$, $f_2$ and $f_3$ with respect to these operating points can be read.

In order to get perfect circulation, the second circulation condition must be satisfied at each operating point, which is graphically demonstrated as follows. The operating points $P_1$, $P_2$ and $P_3$ are projected at the points $Q_1$, $Q_2$ and $Q_3$, respectively, in the diagram of the $\psi/\pi(Z_e/Z_d)$ versus $\kappa/\mu$ relationship that can be computed from the right-hand term of said second conditional equation. To satisfy the second circulation condition, the left-hand term of said second circulation conditional equation must be equal to the right-hand term of the same second circulation equation. It means that the points $Q_1$, $Q_2$ and $Q_3$ must be adjusted to be aligned along the curve of $(\psi/\pi)(Z_e/Z_d)$, for which an approximate expression taken from Richardson's formula for the wave impedance of the stripline (Richardson, "An approximate formula for calculating $Z_0$ of symmetric stripline," IEEE Trans. on Microwave Theory and Tech. (Corresp.), vol. MTT-15, pp. 130–131, February 1967) is adopted. That is $$\frac{\psi}{\pi}(Z_e/Z_d) = \sqrt{\epsilon_d\mu_e/\epsilon_2}\ \frac{1}{\frac{\pi r_2}{w}\log_e\left(\frac{w+D}{w+t}\right)^2}, \tag{13}$$

where w is the width of the stripline and approximated by $w \simeq 2\psi r_2$, $\epsilon_3$, and $\mu_2$ are specific permittivity and effective permeability of the ferrite, $\epsilon_d$ is the specific permittivity of a dielectric pervading the stripline. The geometry of stripline is specified by D the distance between two ground planes, and w the width and t the thickness of the center conductor.

The circulation adjustments are completed if the points $Q_1$, $Q_2$ and $Q_3$ become intersections of the curves of (13) and the curves obtained from the right-hand term of said second conditional equation. It is easier to make two operating points simultaneously satisfy the second circulation condition. Then, the DCFO takes place. The circulation adjustments of the DCFO are actually achieved by changing several factors: coupling angle $2\psi$ of the stripline used, dielectric pervading the stripline and that of the center disk, and applied biasing magnetic field intensity. To achieve multiple circulation frequency operation, circulation adjustments with more operating points than those of DCFO must be simultaneously satisfied.

As for DCFO, there is a choice between combinations of circulating modes with a common direction and with opposite directions. The DCFO with the same positive direction of circulation is nothing but normal circulator actions at two different frequencies. The other DCFO with opposite directions of circulation is called double circulation direction operation in my aforesaid U.S. Pat. No. 4,122,418. Insofar as the Y-junction is concerned, the double circulation direction operation is diplexer operation. The diplexer operation, for instance, is achieved with the combination of circulating modes 1A(−) and 2A(+), where signs in parentheses denote directions of circulation.

The input impedance matching is important after circulation adjustments. As is well known, the device is usually standardized to have 50-Ohm lines for connection. The input impedance matching of the Y-junction to the 50-Ohm lines is practically achieved with facility by using stripline tapers.

Performance examples of an F/D composite Y circulator are demonstrated in FIG. 11. The ferrite ring used in the composite is 20 mm in diameter, 2.5 mm thick with $r_1/r_2=0.45$. The ferrite material is of the saturation magnetization of $4\pi M_s=950$ Gauss and the specific permittivity of $\epsilon_2=14.5$. The dielectric disk has the specific permittivity $\epsilon_1=1.0$. The junction coupling angle $2\psi$ is 0.8 radians, and the thickness of the center conductor t is 0.2 mm.

FIG. 11-*a* shows the circulator performances when the biasing magnetic field is sequentially changed. There are shown four cases in accordance to different magnetic field intensities. The cases (1) and (2) show typical DCFO performances having double peaks of isolation. The cases (3) and (4) show the performances in which additional circulations take place. It is found that circulating modes 1, 1A, 3 and 2A play their distinct roles in the performance of the case (4). Another example of the DCFO is shown in FIG. 11-*b*, which is the case that the F/D composite is surrounded with a dielectric material. The performance in this case is identified that circulating modes 1 and 3 play their roles. Circulation of modes 1A is excluded by use of a dielectric of the specific permittivty of $\epsilon_d=10$, because the wave impedance of the stripline is decreased to match the junction wave impedances of modes 1 and 3.

Figure 12:
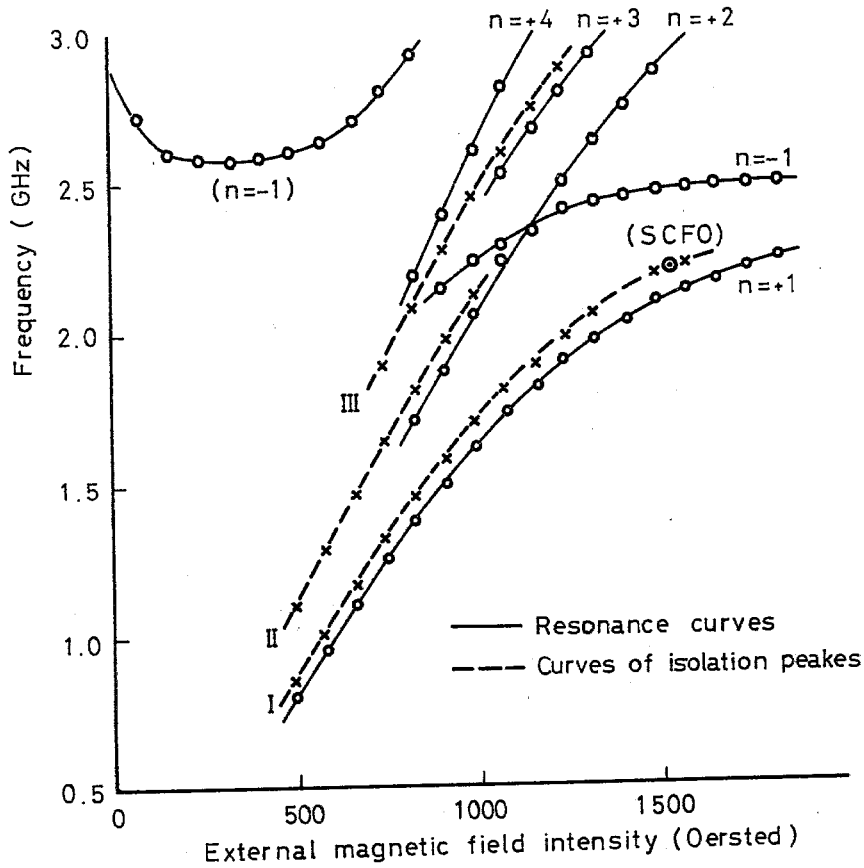
FIG. 12 is the mode chart in which measured frequencies of maximum isolation are superimposed. The specifications of the F/D composite used are such that $4\pi M_s=750$ Gauss, $\epsilon_2=14.5$, $\epsilon_1=1.0$, $r_1/r_2=0.45$, $r_2=10$ mm, and $2\psi=0.8$ radians. Curves I, II, and III stand for circulations of modes 1, 1A, and 3.

The performance mechanism of double or multiple circulation frequency operation is traced in the mode chart which is shown in FIG. 12. Measured frequencies of maximum isolation are plotted superimposed in the mode chart. The specifications used in the experiment are that the saturation magnetization of the ferrite is $4\pi M_s=750$ Gauss, its specific permittivity $\epsilon_2=14.5$, the specific permittivity of the dielectric tric disk $\epsilon_1=1.0$, the radius of the composite $r_2=10$ mm, the radius ratio $r_1/r_2=0.45$, and the junction coupling angle $2\psi$ is 0.8 radians. A number in parentheses shows a resonant mode below resonance. It is understood that circulations in the low biasing magnetic field are operations marked by I and II, and circulation marked by III additionally takes place in the high biasing magnetic field. The curves of maximum isolation I, II, and III stand for circulating modes 1, 1A and 3, respectively.

Figure 13:
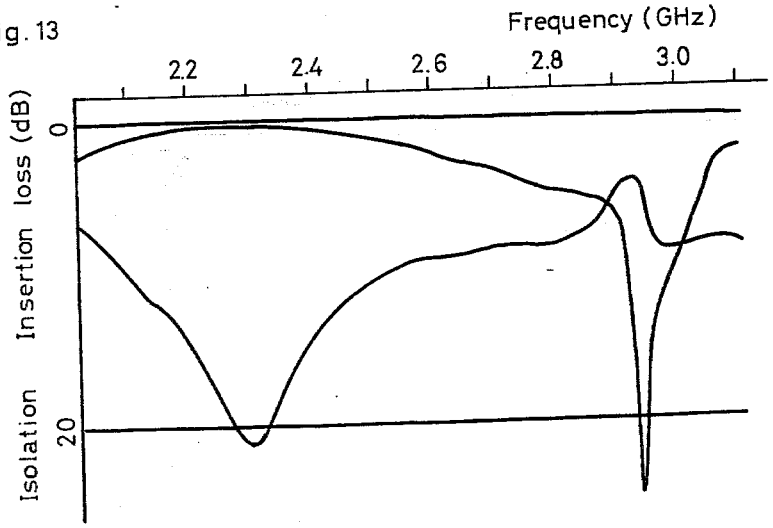
FIG. 13 shows a performance example of diplexer operation in the case of the F/D composite circulator, in which circulating modes 1A and 2A play their respective roles.

An example of diplexer operation with an F/D composite is shown in FIG. 13. It is the case that circulating modes 1A and 2A play their distinct roles. The specifications used are such that $4\pi M_s=950$ Gauss, $\epsilon_2=14.5$, $\epsilon_1=1.0$, $r_1/r_2=0.43$, $r_2=10.5$ mm, and the thickness h' is 2.5 mm.

III. On performance of F/C composite Y circulators

An F/C composite is prepared by combining a center conductive disk and a ferrite ring into a disk configuration with a common thickness. The composite pair is loaded in the stripline Y-junction, as shown in FIG. 2-*b*.

The em fields in the F/C composite are induced from the em fields of the F/D composite given in Eqs. (1) through (11), by letting $k_1$ tend to zero and $n_1=\sqrt{\epsilon_0\epsilon_e/\mu_0}$ tend to infinity. It is also assumed that the electric field has only a z-component, vanishing at the surface of the center conductive disk, and the em fields are independent of the z-coordinate. The electric field in the ferrite ring is given by $$E_z = \sum_{n=-\infty}^{\infty} a_n\{J_n(k_e r) + b_n Y_n(k_e r)\}e^{-jn\theta}, \tag{14}$$

where $b_n=-J_n(k_e r_1)/Y_n(k_e r_1 9$, and $k_e$ equals $k_2$ of the F/D composite. Other field components are obtained from Eqs. (7) and (8). The TM mode is defined by the condition of a magnetically short-circuited edge at the periphery of the F/C composite. The TM mode of the n-th order ($n=0_1\pm 1_1\pm 2$, is given by $$F_n - \frac{\kappa}{\mu}\ \frac{n}{k_e r_2} F_n = 0, \tag{15}$$

where $$\begin{cases} F_n = J_n(k_e r_2) + b_n Y_n(k_e r_2), \\ F_n = J_n'(k_e r_2) + b_n Y_n'(k_e r_2), \\ b_n = -J_n(k_e r_1)/Y_n(k_e r_1). \end{cases} \tag{16}$$

Figure 14:
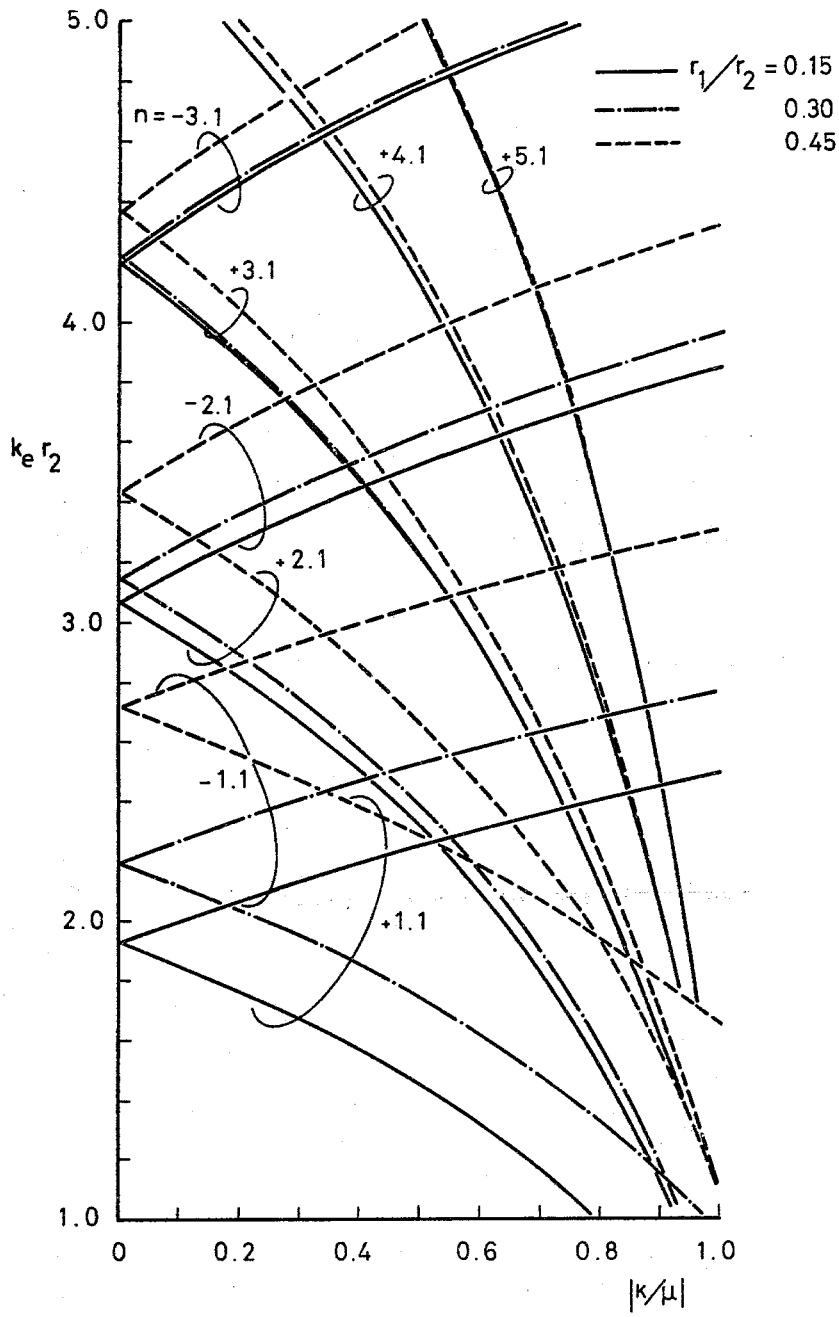
FIG. 14 shows resonant mode curves of an F/C composite as a function of $r_1/r_2$. The ferrite used is such that the saturation magnetization $4\pi M_s$ is 1200 Gauss, and the specific permittivity $\epsilon_e$ is 14.5.

Computed results of resonant TM modes are shown in FIG. 14, as a function of the ratio $r_1/r_2$ with a given saturation magnetization $4\pi M_2=1200$ Gauss. If $r_1/r_2$ is increased, resonant mode curves generally shift upwards.

Figure 15:
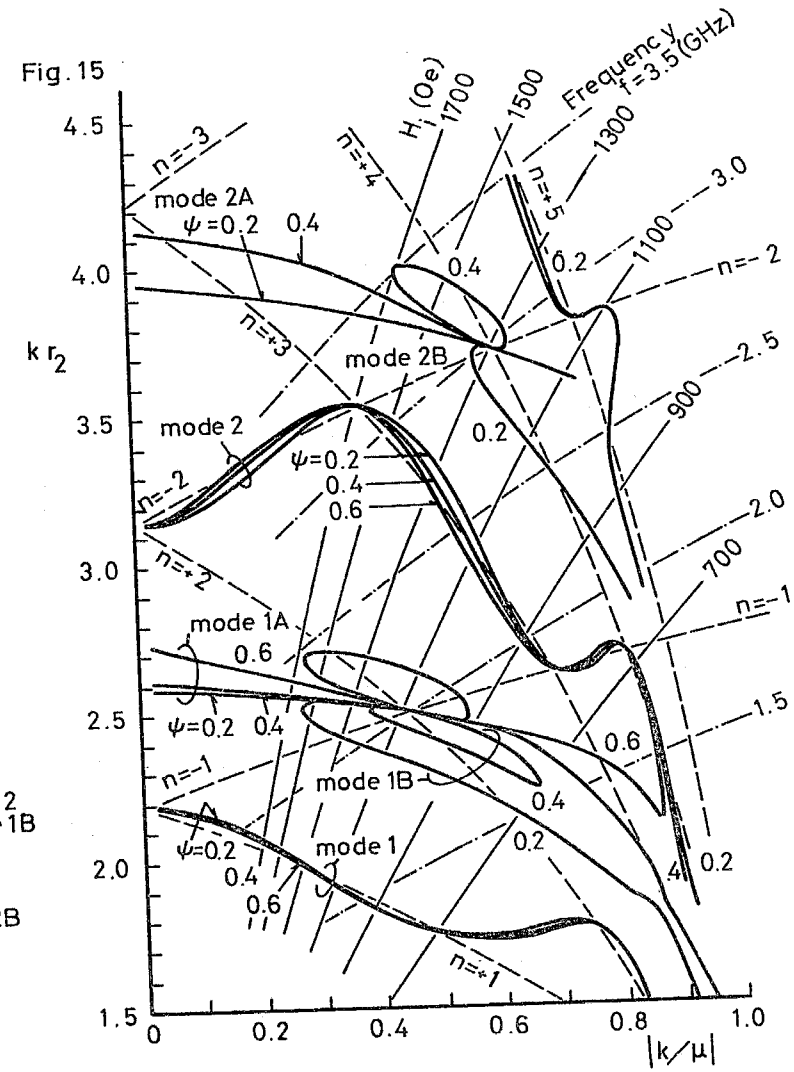
FIG. 15 shows the first circulation conditional curves for the F/C composite Y circulator. The parameters used are such that $4\pi M_s=1200$ Gauss, $\epsilon_e=14.5$, $r_1/r_2=0.3$, and $r_2=10$ mm.
Figure 16:
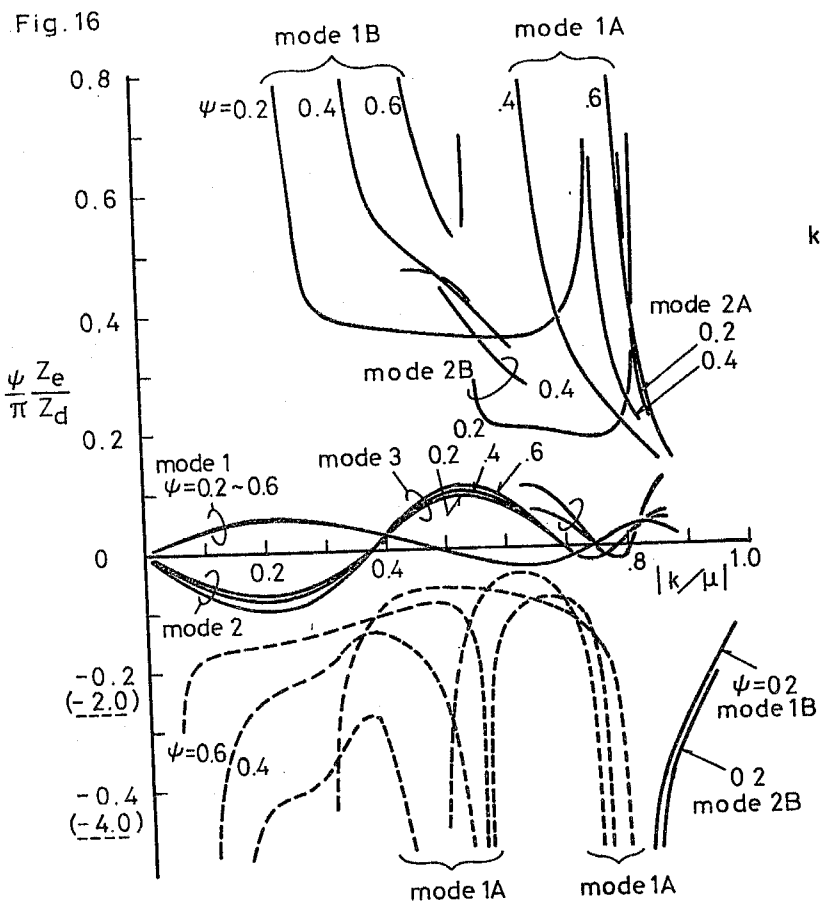
FIG. 16 shows the second circulation conditional curves computed from the right-hand term of the second conditional equation for perfect circulation. The same parameters are used as in the first circulation conditional curves given in FIG. 15.
Figure 17:
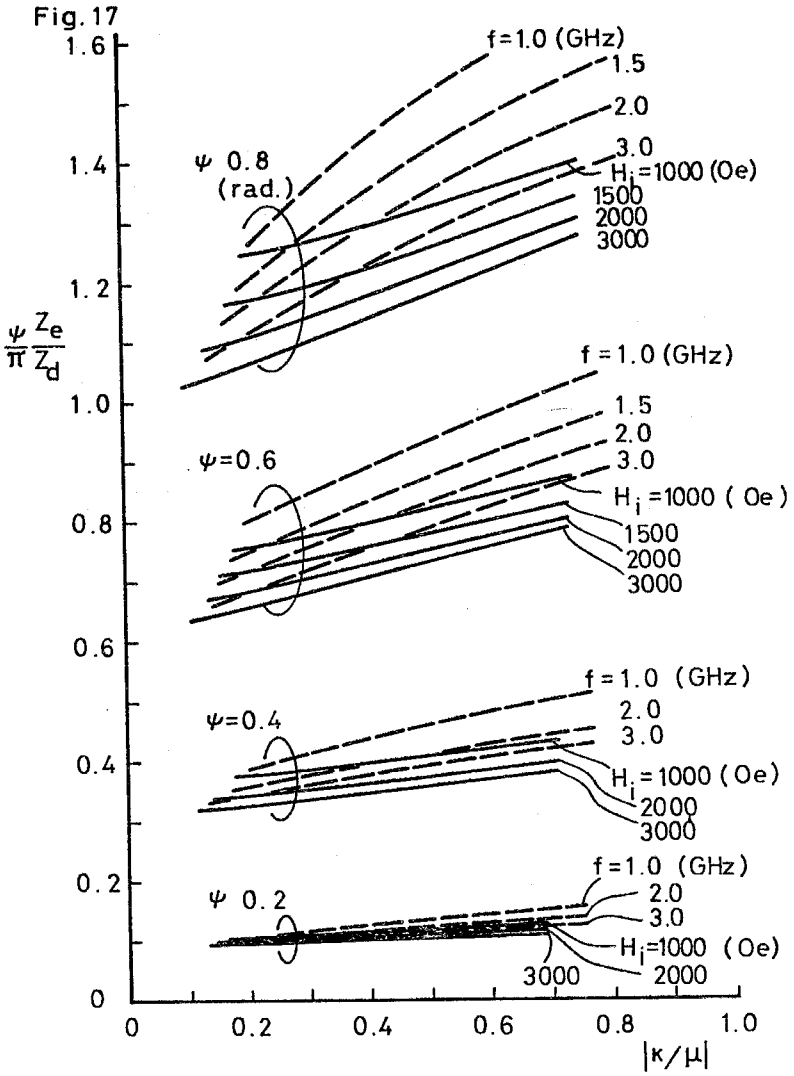
FIG. 17 shows the computed results of the left-hand term of the second conditional equation, corresponding to the second conditional curves given in FIG. 16.

The first and second circulation conditional curves are obtained by substituting quantities defined by Eq. (16) into Eqs. (4), (5), (8), and (9) in the specification of my aforesaid U.S. Pat. No. 4,122,418, and by computing them. Computed results of the first circulation condition and the right-hand and left-hand terms of the second circulation condition are shown in FIGS. 15, 16, and 17, respectively. Computation is made retaining terms up to $n=6$ among resonant modes and by using the Polder's equations of tensor permeability for above resonance. The parameters used are such that the saturation magnetization of the ferrite $4\pi M_s$ is 1200 Gauss, its specificpermittivity $\epsilon_e$ is 14.5, the radius $r_2$ is 10 mm, and the ratio $r_1/r_2$ is 0.3.

Two different loci of constant internal magnetic field intensity and constant frequency are superimposed in the first conditional curves as shown in FIG. 15. The left-hand term of the second circulation conditional equation is computed by using the relationship of $(\psi/\pi)(Z_e/Z_d)$ given in (13), with the parameters that the specific permittivity of a dielectric pervading the stripline $\epsilon_d$ is 1.0, and $D=5.2$ mm, and $t=0.2$ mm for the dimension of the stripline.

The features of the first and second circulation conditional curves are summarized as follows.

(1) No curve of mode 1 goes through the intersection of resonant mode curves $n=-1$ and $+2$, and the values of $\psi/\pi(Z_e/Z_d)$ for mode 1 are as small as those of mode 2.

(2) Mode 1A curves lie in the regions of an acute angle between the resonant curves $n=-1$ and $+2$, while mode 1B curves lie in the neighborhood of mode 1A. Modes 1A and 1B have useful values of $(\psi/\pi)(Z_e/Z_d)$ but they are larger than those of modes 1 and 2, and modes 1A and 1B have opposite signes of $(\psi/\pi)(Z_e/Z_d)$, suggesting opposite-sense circulations.

(3) Modes 2A and 2B are considered to be as useful as modes 1A and 1B, since these modes have desirable values of $(\psi/\pi)(Z_e/Z_d)$ for circulation adjustments.

The above-mentioned features are closely dependent on the ratio $r_1/r_2$ and the saturation magnetization $4\pi M_s$, so that variation of $r_1/r_2$ and $4\pi M_s$ cause to modifiy the first and second conditional curves. With a given saturation magnetization, increasing of $r_1/r_2$ causes to shift the first conditional curves to the higher frequencies and generally to decrease the values of $(\psi/\pi)(Z_e/Z_d)$ in the region above resonance. With a given geometry of the F/C composite, increasing of $4\pi M_s$ causes to shift the first conditional curves to the lower frequencies.

Circulation adjustments with the F/C composite can be achieved following the same procedure as has been used with the F/D composite Y circulator. If small values of $(\psi/\pi)(Z_e/Z_d)$ is chosen, circulations of modes 1 and 3 seem possible. With large values of $(\psi/\pi)(Z_e/Z_d)$, circulations of modes 1A, 1B, 2A, and 2B seem possible.

It is remarked that with the F/C composite, three types of multiple circulation frequency operation are achieved, i.e., multiple circulation frequency operation, broadband operation and diplexer operation. A multiple circulation frequency operation is such that two or more narrow-band circulations takes place at different frequencies with a common direction of circulation, the isolation being bounded by less than 20 dB at inter-circulation frequencies, and therefore the whole frequency band splits into so many narrow bands. A broadband operation is performed when circulation adjustments are achieved to have at least 20-dB isolation at inter-circulation frequencies, by using a comparatively thin conductor of an appropriate geometry in the composite. A diplexer operation is performed with the F/C composite. The center conductor in the composite has a role to decrease the value of $(\psi/\pi)(Z_e/Z_d)$ for mode 1A, 1B, 2A, and 2B. Consequently, circulations with these modes can be achieved with facilty.

Specifically speaking, with the F/C composite having the ratio $r_1/r_2=0.2\sim0.25$, circulations of modes 1B, 2A and 2B are prevailing, and with the F/C composite having the ratio $r_1/r_2\geqq0.3$, circulations of modes 1A, 2A, and 2B are prevailing. Therefore if the ratio $r_1/r_2$ is chosen intermediate between the preceding two cases, circulations including modes 1A, 1B, 2A, and 2B are possible. Then, switching operation which is disclosed in the specification of my aforesaid U.S. Pat. No. 4,122,418 can be performed.

Diplexer operation, as early mentioned, does not solely belong to a F/C composite Y circulator, but is widely achieved with the ferrite composite of the invention.

To demonstrate the diplexer operation, performance examples are shown in FIGS. 18-*a* and *b*. FIG. 18-*a* is for the case that the saturation magnetization $4\pi M_s$ of the ferrite is 1200 Gauss, the ratio $r_1/r_2$ is 0.3, the radius $r_2$ is 10 mm and the thickness of the composite is 2.5 mm. FIG. 18-*b* is for the case that $4\pi M_s=750$ Gauss, $r_1/r_2=0.25$, $r_2=10$ mm, and $h'=2.5$ mm. $\psi$ half the coupling angle is commonly 0.6 radians. The preformances clearly demonstrate that two opposite circulations take place at different frequencies.

Figure 19:
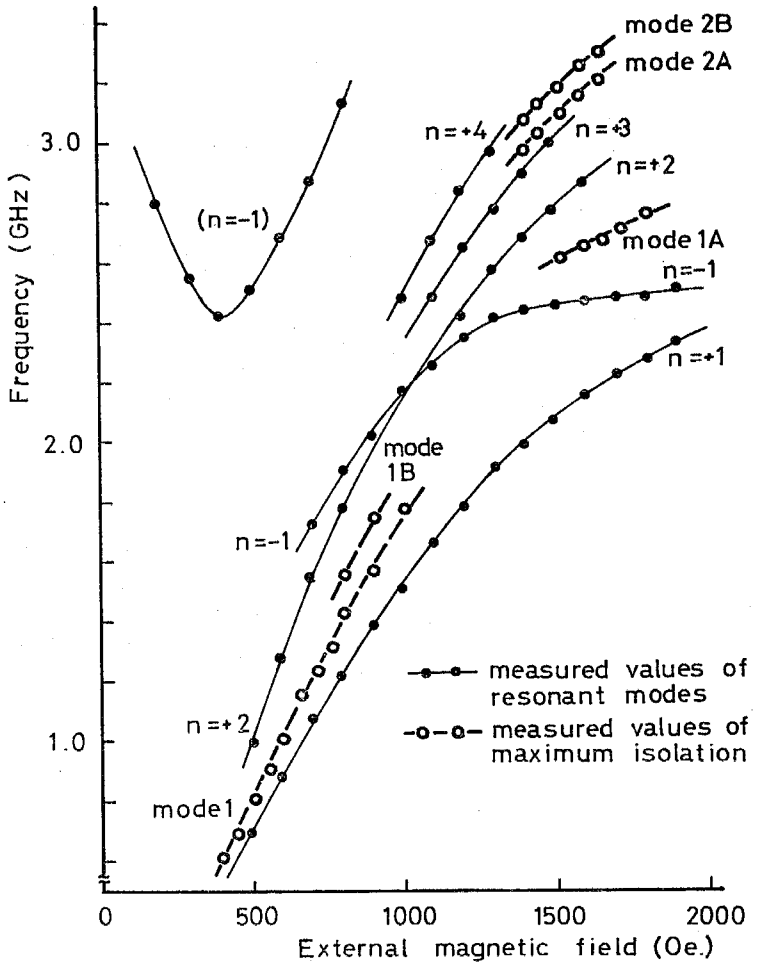
FIG. 19 is the mode chart in the case of diplexer operation shown in FIG. 18-*a*.

To identify circulating modes, measured frequencies of maximum isolation are plotted superimposed in the mode chart of the F/C composite resonator as shown in FIG. 19. Two broken lines between the resonant mode curves $n=+1$ and $-1$ correspond to modes 1 and 1B, with the low biasing magnetic field. When the biasing magnetic field is increased after intersection of the resonant curves $n=-1$ and $+2$, the diplexer operation takes place. Circulation of mode 1A takes place in the region between the resonant curves $n=-1$ and $+2$. Modes 2A and 2B take place in the neighborhood of the resonant curve $n=+4$. These experimental results are in agreement with the theoretical curves of the first circulation condition which is shown in FIG. 15. The diplexer operation shown in FIG. 18-*a* is related to the results given in FIG. 19.

IV. On performance of F/D/C composite Y circulators

An F/D/C composite is prepared by inserting a conductive post inside the above-mentioned F/D composite, as shown in FIG. 1-*c*. The main purpose of the conductive post is to improve circulator characteristics from the viewpoint of multiple circulation frequency operation. Among various versions of multiple circulation frequency operation, only broadband operation is cited as a performance example with the F/D/C composite.

As early mentioned in the F/D composite circulator, the multiple circulation frequency operation is performed such that the whole frequency band is split into several narrow bands with less isolations than the 20-dB level in the inter-circulation frequencies. Improving of less isolations in inter-circulation frequencies eventually gives a broadband operation.

An F/D/C composite is intermediate between an F/D composite and an F/C composite, and so it can intrinsically bear two characters originating from two extremes, which is seen from the preceding two kinds of the perfect circulation conditional curves shown in FIGS. 8, 9, 15 and 16.

Figure 20:
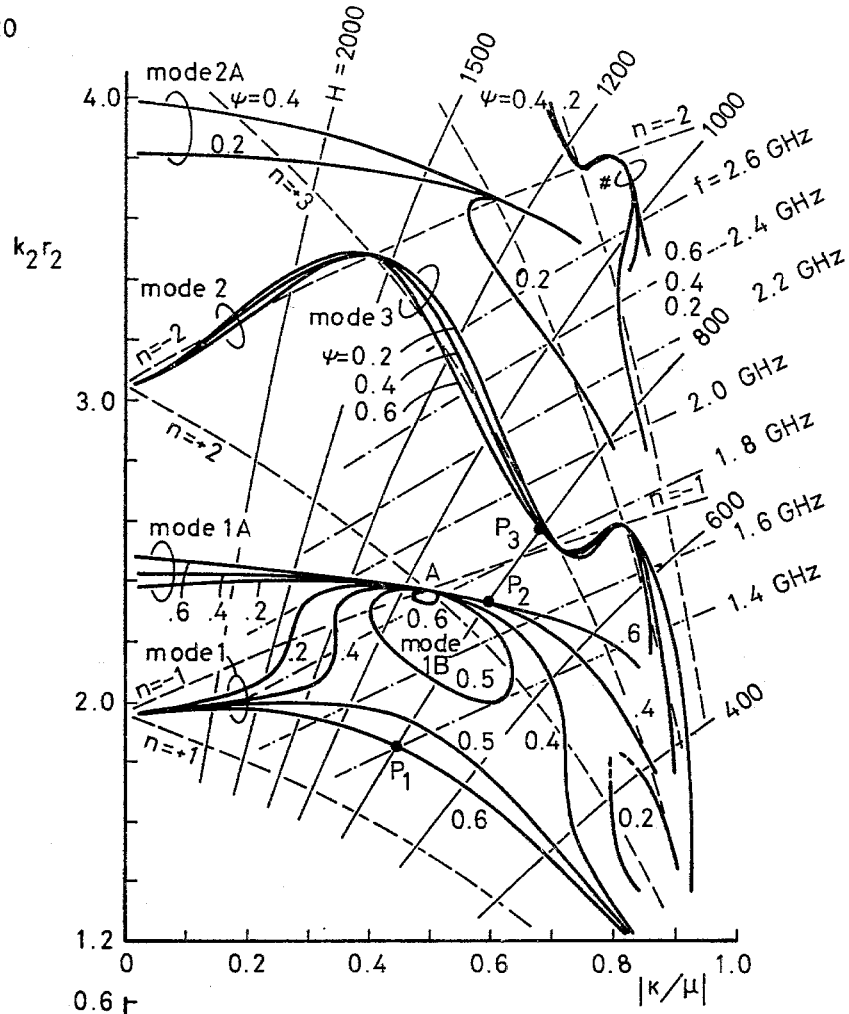
FIG. 20 shows the relationships of resonant mode curves and the first circulation conditional curves for the case of an F/D/C composite circulator. The parameters used are such that $4\pi M_s=1200$ Gauss, $\epsilon_2=14.5$, $\epsilon_1=1.0$, $r_1/r_3=0.15$, $r_2/r_3=0.3$, and $r_3=10$ mm.
Figure 21:
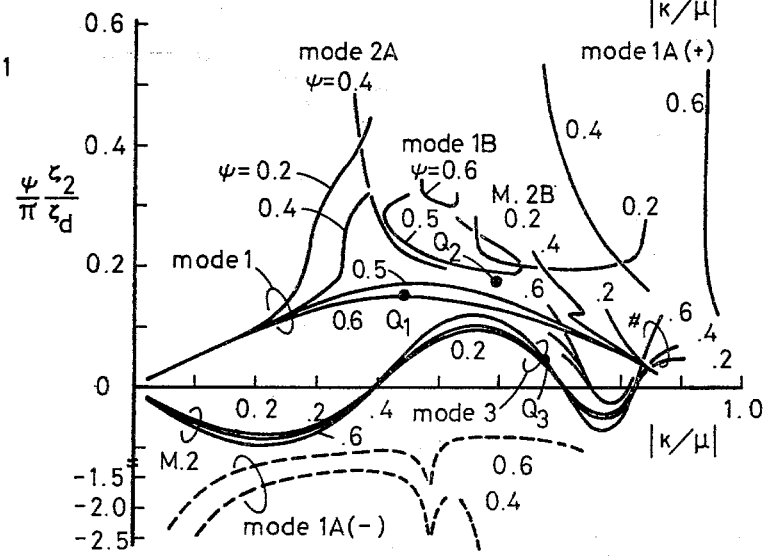
FIG. 21 shows the second conditional curves computed from the right-hand term of the second conditional equation, corresponding to the first conditional curves given in FIG. 20.

Computed results for the perfect circulation condition are shown in FIGS. 20 and 21. They are functions of radius ratios $r_1/r_3$ and $r_2/r_3$, wave propagation constant ratio $k_1/k_2$, and intrinsic wave impedance ratio $Z_1/Z_2$. $r_1$, $r_2$, and $r_3$ are radii of the conductive post, the dielectric ring and the ferrite ring, respectively. $k_1$, and $k_2$ are radial wave propagation constants in the dielectric ring and ferrite ring, respectively. $Z_1$ and $Z_2$ are wave impedances of the dielectric and ferrite, respectively. These parameters are chosen in accordance with the circulator used in the experiments given later. They are such that $r_1/r_3=0.15$, $r_2/r_3=0.3$, $r_3=10$ mm, the saturation magnetization of the ferrite $4\pi M_s=1200$ Gauss, its specific permittivity $\epsilon_2=14.5$, and $\epsilon_1=1.0$.

The first conditional curves are featured as such that mode 1 curves are almost similar to those of an F/D composite if $\psi<0.5$ and $\psi>0.6$, and mode 1B curves split from mode 1 curves; and other higher-order mode curves seem similar to those of the F/D composite. It is marked in the second conditional curves that mode 1 curves, for $0.5<\psi<0.6$ and $0.3<\kappa/\mu<0.6$, flatly run holding the values of $(\psi/\pi)(\zeta_2/\zeta_d)$ which is nearly equal to 0.2, as well as modes 1B, 2A, and 2B, but mode 3 holds a slightly low value $(\psi/\pi)(\zeta_2/\zeta_d)$ even at its maximum at $\kappa/\mu\simeq0.5$. These conditions are desirable for adjustment of the second circulation condition in the intercirculation frequency, because such conditional curves can coincide over a wide range with a locus of constant internal magnetic field for the second circulation condition as shown in FIG. 17.

Operating points, for instance, $P_1$, $P_2$ and $P_3$, are determined by intersections of the first conditional curves and a locus of internal magnetic field $H_i=800$ Oe., and specified by sets of $\kappa/\mu$, $H_i$ and frequency. The second condition must be satisfied at these points to get perfect circulation. This is also achieved in such a graphical way that points $Q_1$, $Q_2$ and $Q_3$, which are found on respective mode curves corresponding to $P_1$, $P_2$ and $P_3$, are adjusted to lie on one locus of the same magnetic field intensity of $H_i=800$ Oe. in the curves of $(\psi/\pi)(\zeta_2/\zeta_d)$ versus $\kappa/\mu$ relationship given in FIG. 17. Such circulation adjustments can be performed with facility when two operating points are chosen from modes 1 and 1A. Multiple circulations with so many operating points can be adjusted likewise.

Figure 22:
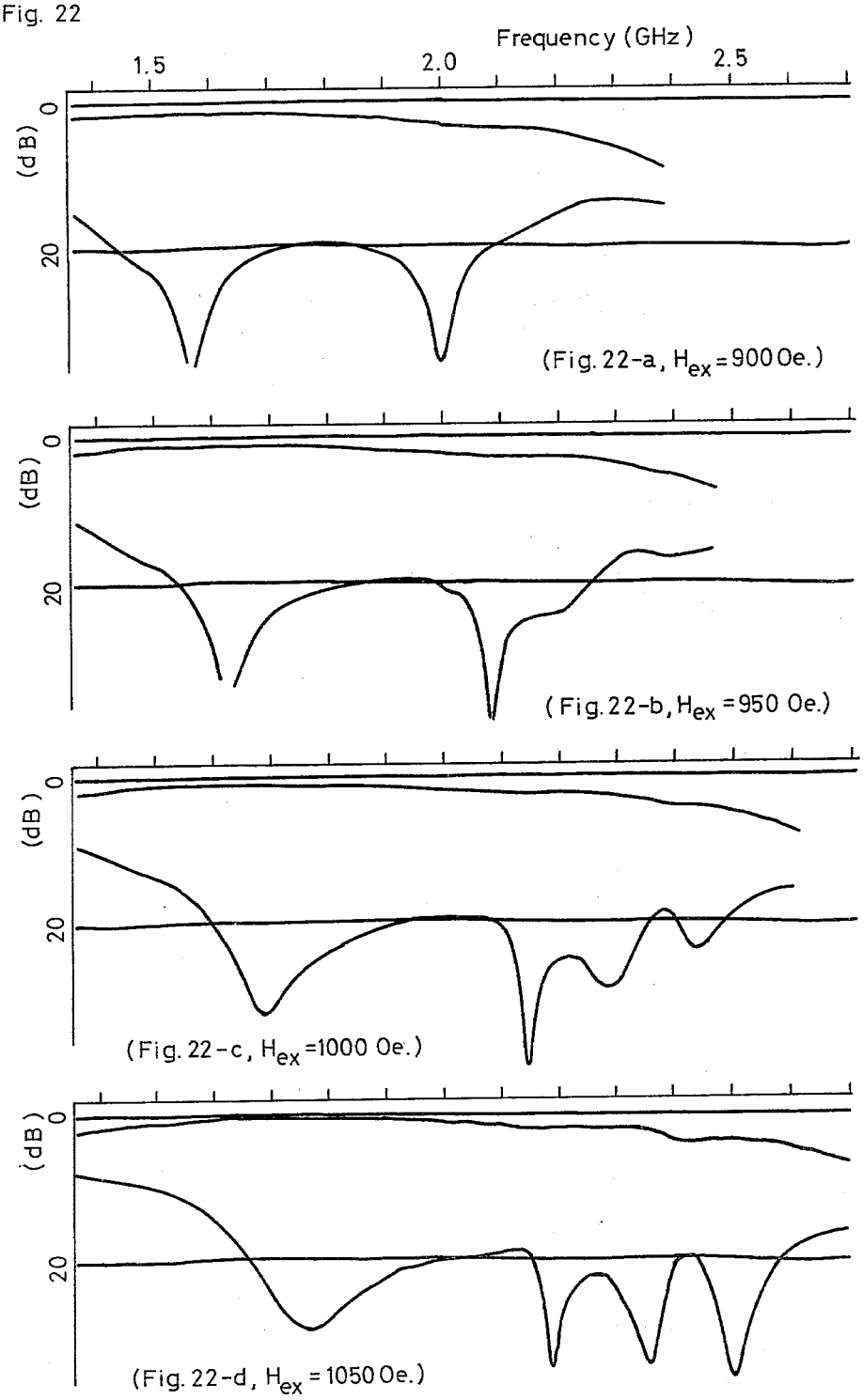
FIG. 22 demonstrates performance examples of broadband operation in the case of an F/D/D composite Y circulator.

Experimental examples are demonstrated in FIG. 22. The composite used is made from a ferrite ring with the radii $r_3=10$ mm and $r_2=3$ mm, and a conductive post with the radius $r_1=1.5$ mm. The ferrite material is of Al-YIG, with such specifications that $4\pi M_2=1200$ Gauss, and $\epsilon_2=14.5$. The stripline width is 11 mm, which correponds to $\psi=0.58$ radians. Stripline tapers are used to connect the Y-junction to external transmission lines.

Typical performances have been obtained with sequential change of the biasing magnetic field around the field intersity $H_{ex}=1000$ oe. Circulator actions are featured by double to four peaks of isolation, with the magnetic field increased. The insertion losses show a tendency to slightly increase in the vicinity of the highest circulation frequency. The frequency band reaches 45 percent when four circulations are put into use.

To identify circulating modes, circulation frequencies measured from isolation peaks are plotted superimposed in the mode chart of the F/D/C composite resonator as shown in FIG. 23. Mode 1 circulation takes place in the region bounded by resonant curves $n=+1$, $-1$ and $+2$. Mode 1A circulation is in the region bounded by resonant curves $n=-1$, $+2$ and $+3$. Mode 3 circulation is almost coincidental with the resonant curve $n=+3$, and also mode 2A circulation coincidental with the resonant curve $n=+4$. Location of these modes, including mode 1B, agrees with the first conditional curves shown in FIG. 20.

The broadband operation with the F/D/C composites can be described in terms of these circulating modes. Modes 1 and 1A play their respective roles in the DCFO under the low biasing magnetic field. As the biasing magnetic field is increased, other higher-order modes come to join in the broadband operation. The experiment shows that circulating modes 1, 1A, 3 and 2A played their distinct roles in the broadband operation.

V. On performance of F/F composite Y circulators

An F/F composite is prepared, for instance, by combining a center ferrite disk and a closely fitting ferrite ring of mutually different saturation magnetization into a disk configuration. Two cases can be considered. One is such that the center ferrite disk has higher saturation magnetization than that of the ferrite ring, and the other is the the inverse version of the preceding one. For the sake of convenience, the former case is treated. The F/F composite and its Y circulator are shown in FIG. 24, in which two ground planes are not shown.

Initially, two ways of biasing magnetic field are mentioned, uniform and noniniform illuminations, above resonance. Biasing field is commonly applied parallel to a common axis of the composite structure.

If the composite structure is placed under a uniform biasing magnetic field $H_3$, each ferrite portion is affected by a different internal magnetic field intensity approximately given by $$H_{ij} = H_e - \frac{1}{\mu_0} 4\pi M_{sj}, \tag{17}$$

where $j=1$ stands for the center ferrite disk, and $j=2$ for the ferrite ring. Consequently, each ferrite portion has different effective permeability $\mu_e$, and anisotropic splitting factor $\kappa/\mu$, and therefore the composite structure has radially stepwise distribution of not only $\mu_e$ but also $\kappa/\mu$ as shown in FIG. 25. The reason is stated in the specification of my aforesaid U.S. Pat. No. 4,122,418.

The em field wave, penetrating into the composite structure, will be affected by such stepwise discontinuity of $\kappa/\mu$ between the center ferrite disk and the ferrite ring at any frequency. The $\kappa/\mu$ discontinuity may cause such two ferrite composite to act as two independent resonant elements even if they are closely coupled, before these elements function to constitute a totally united resonator. It is therefore considered that the em fields in the composite do not normally present any features which the em fields in a disk-ferrite resonator can possess. Further detailed discussion has been given in my aforesaid U.S. Pat. No. 4,122,418.

On the other hand, if the composite structure is nonuniformly biased magnetically, with the specific intention of producing uniformity of $\kappa/\mu$ inside the two-ferrite composite, then the composite structure will act as a united resonator, having a stepwise distribution of $\mu_e$, as shown in FIG. 26. It is worthy of mention that the composite structure appears as a uniform profile of $\kappa/\mu$ as does the disk ferrite, but has a centripetally stepwise profile of $\mu_e$. Also, the em fields in the composite, although being intrinsically affected by the stepwise profile of $\mu_e$, normally display common features with the em fields in the disk ferrite. Attention is drawn to the circulator actions due to the particular profile of $\mu_3$ as the composite structure retains.

The composite structure of the invention is assumed to be nonuniformly biased magnetically to realize uniformity of $\kappa/\mu$, while a stepwise profile of $\mu_e$ is maintained. Nevertheless, it can be assumed that the electric field has only the z-component and the em fields are independent of the z-coordinate in cylindrical coordinates (r, $\theta$, z). As the em fields in the ferrite disk and ring are shown, applying the continuity conditions of tangential field components at the boundary of $r=r_1$ between two ferrites, the em fields in the ferrite ring ($r_1<r<r_2$) are obtained as follows.

$$E_{2z} = \sum_{n=-\infty}^{\infty} b_n F_n(k_2 r) e^{-jn\theta}, \tag{18}$$

$$H_{2\theta} = -j\eta_2 \sum_{n=-\infty}^{\infty} b_n \{F_n'(k_2 r) - \frac{\overline{K}_2 n}{k_2 r} F_n(k_2 r)\} e^{-jn\theta}, \tag{19}$$

$$H_{2r} = \eta_2 \sum_{n=-\infty}^{\infty} b_n \{\frac{n}{k_2 r} F_n(k_2 r) - \overline{K}_2 F_n'(k_2 r)\} e^{-jn\theta}, \tag{20}$$

where $$\begin{cases} F_n = J_n(k_2 r) + c_n Y_n(k_2 r), \\ F_n' = J_n'(k_2 r) + c_n Y_n'(k_2 r), \\ c_n = -\{J_n'(k_2 r_1) - J_n(k_2 r_1) I_n\}/\{Y_n'(k_2 r_1) - Y_n(k_2 r_1) I_n\}, \\ I_n = \frac{\eta_1}{\eta_2}\left[\frac{J_n'(k_1 r_1)}{J_n(k_1 r_1)} - \frac{\overline{K}_2 n}{k_1 r_1}\right] + \frac{\overline{K}_2 n}{k_2 r_1}, \\ \eta_1 = \sqrt{\epsilon_0 \epsilon_1/\mu_0 \mu_{e1}}, \quad \eta_2 = \sqrt{\epsilon_0 \epsilon_2/\mu_0 \mu_{e2}}, \\ k_1 = \omega\sqrt{\epsilon_0 \epsilon_1 \mu_0 \mu_{e1}}, \quad k_2 = \omega\sqrt{\epsilon_0 \epsilon_1 \mu_0 \mu_{e1}}, \\ \mu_{e1} = \mu_1(1 - \overline{K}_2^2), \quad \mu_{e2} = \mu_2(1 - \overline{K}_1^2), \\ \overline{K}_1 = \kappa_1/\mu_1 = \overline{K}_2, \quad \overline{K}_2 = \kappa_2/\mu_2, \end{cases} \tag{21}$$

$\epsilon_1$, $\mu_{e1}$ are the specific permittivity and effective permeability of the ferrite disk;

$\epsilon_2$, $\mu_{e2}$ re the specific permittivity and effective permeability of the ferrite ring;

$\kappa_1$, $\mu_1$ are elements of tensor permeability of the ferrite disk;

$\kappa_2$, $\mu_2$ are elements of tensor permeability of the ferrite ring, and $r_1$, $r_2$ are the radii of the ferrite disk and ring, respectively.

The TM mode of the composite is determined by the condition of a magnetically short-circuited edge at the periphery of the F/F composite. Resonant curves of the TM mode are computed from the following transcendential equation of the n-th ($n=0,\pm1,\pm2,$)

$$F_n'(k_2 r_2) - \frac{\overline{K}_2 n}{k_2 r_2} F_n(k_2 r_2) = 0, \tag{22}$$

where the uniformity condition of $\kappa/\mu$ is retained, i.e., $\overline{K}_1=\overline{K}_2$.

Computation of (22) is made above resonance. The parameters used are such that the saturation magnetizations of the ferrite disk and ring are $4\pi M_{s1}=1200$ Gauss, $4\pi M_{s2}=750$ Gauss, respectively, the specific permittivities of two ferrites are commonly $\epsilon_1=\epsilon_2=14.5$, the ratio $r_1/r_2$ is 0.45, and the radius of the composite $r_2$ is 10 mm. Computed results for resonant modes up to $n=4$ are shown in FIG. 27. It can be generally seen that if only $4\pi M_{s1}$ is increased from $4\pi M_{s2}$, the resonant mode curves move downwards with less variation as to higher orders of n, and that if $r_1/r_2$ is either increased or decreased, each mode curve moves upwards from its lowest extreme position.

In order to know whether the Y-junction loaded with the composite operates in broadband operation, operating points are examined from the viewpoint of relevant circulation adjustments. Two circulation conditional curves are obtained by computing the first and second circulation conditional equations given in my aforesaid U.S. Pat. No. 4,122,418, Eqs. (8) and (9) in column 5. Computation of the first conditional equation and the right-hand term of the second conditional equation is carried out above resonance, by retaining terms up to $n=6$, and also using the Polder's equations of tensor permeability. Higher order terms than $n=6$ are not necessary for obtaining only conditional curves of mode 1 circulation. The composite structure has parameters such that the saturation magnetizations of the ferrite disk and ring are $4\pi M_{s1}=1200$ Gauss, $4\pi M_{s2}=750$ Gauss, respectively, and their specific permitivities are the same value $\epsilon_1=\epsilon_2=14.5$, with the geometry such that $r_2=10$ mm and $r_1/r_2=0.45$. $\psi$ is half the coupling angle of the stripline used. Computed results are given in FIGS. 28-*a* and *b*.

Computation of the left-hand term of the second circulation conditional equation is carried out using the relation $$Z_2/Z_d=\sqrt{\epsilon_{eq}\mu_{e2}/\epsilon_2}, \tag{23}$$

where $\epsilon_d$ is the wave impedance of the stripline, and $\epsilon_{eq}$ is an equivalent permittivity assumed to include all the factors depending on the geometry of the stripline and dielectric pervading therein. Computed results ate shown in FIG. 28-*c*, only for $\psi=0.6$. From these, the conditional loci of constant internal magnetic field for the second circulation condition can be obtained.

For the sake of understanding, though it digresses from the subject, the first and second circulation conditional curves are compared between the F/F composite circulator and the disk-ferrite circulator, with the common parameters that the saturation magnetization of the disk ferrite $4\pi M_s$ is chosen to the same as that of the ring ferrite $4\pi M_{s2}=750$ Gauss, its specific permittivity $\epsilon_e$ is 14.5, and the radius $r_0$ is 10 mm. Computed results for the dis-ferrite Y circulator are shown in FIGS. 29-*a* and *b*.

The conditional curves for $\psi=0.6$ of mode 1 present a sharp contrast. The curve of $\psi=0.6$ for the case of the F/F composite changes in the S-like curve in the low values of $\kappa/\mu$ and in the Z-like curve in the high values of $\kappa/\mu$, both in the first and second conditional curves as shown in FIGS. 28-*a* and *b*. While the curves of $\psi=0.6$ in the case of the disk ferrite changes in much smoothed S- and Z-like curves in the first and second conditional curves as shown in FIGS. 29-*a* and *b*. It is marked that the S-like first conditional curve of $\psi=0.6$ in the case of the F/F composite intersects a locus of internal magnetic field intensity at two or three points, from which at least two operating points are considered to satisfy the second circulation condition for broadband operation. It is also the case with the disk ferrite, insofar as the S-like part of the conditional curves is concerned.

Two operating points $P_1$ and $P_2$, for instance, on the locus $H_i=750$ Oe. in the first conditional curve and points $Q_1$ and $Q_2$ in the second conditional curves are found as indicated in FIGS. 28-*a* and *b*. To obtain the broadband operation given by these operating points, $Q_1$ and $Q_2$ must be on the line of $H_i=750$ Oe. in the $(\psi/\pi)(Z_3/Z_d)$ versus $\kappa/\mu$ diagram shown in FIG. 28-*c*. Following the graphical way of satisfying the second condition, it is found that the second condition is not simultaneously satisfied at the points $Q_1$ and $Q_2$, and consequently circulation adjustments will be incomplete. The same results may be seen even in the worse in the case of the disk ferrite circulator if circulation adjustments are examined with both the second conditional curves given in FIG. 29-*b* and the curves of the $(\psi/\pi)(Z_e/Z_d)$ versus $\kappa/\mu$ relationship shown in FIG. 28-*c*. It is understood that higher-order circulations in the F/F composite circulator have as large values of $(\psi/\pi)(Z_e/Z_d)$ as those in the disk ferrite circulator, though they are not fully shown in FIGS. 28-*a* through 29-*b*.

The other alternative is to use the Z-like parts of the conditional curves in the region below resonance. Computation of the two conditional equations for perfect circulation is carried out, partly, using the Polder's equations and, partly, by using the Green and Sandy's equations. Computed results are, however, restricted within a narrow region in which a portion of the Z-like conditional curve is fortunately found in the vicinity of the zero internal magnetic field intensity in terms of the Polder's equations, or in the vicinity of the saturation magnetization in terms of the Green and Sandy's equations. Internal magnetic field loci in the neighborhood of its zero value are shown in FIG. 30.

In order to find operating points in the region below resonance, two kinds of loci of internal magnetic field intensity are superimposed in the respective conditional curves as shown in FIGS. 31-*a* and *b*. Locus $H_i=A$ indicates a case that the internal magnetic field locus intersects both S- and Z-like parts of the conditional curve, and locus $H_i=B$ indicates a case that the internal field locus intersects only the Z-like part of the conditional curve. Relevant circulation adjustments can be seen from the inter-relationship between the S- and Z-like conditional curves and the internal magnetic field loci $H_i=A'$ and $B'$.

The circulation adjustments are not so simple as those in the case of the disk-ferrite circulator, because of adjustment of the nonuniform magnetic field to produce uniformity of $\kappa/\mu$ inside the composite. However, the circulation adjustments at two points $S_1$ and $S_2$ on the locus $H_i=B'$ corresponding to operating points $R_1$ and $R_2$ on the locus $H_i=B$ are considered to be achieved rather with facilty than those on the field locus $H_i=A'$, since $S_1$ and $S_2$ are located very close to one another, having almost the same value of $(\psi/\pi)(Z_e/Z_d)$ in comparison with the case of $H_i=A'$.

Experimental examples are shown in FIGS. 32 and 33. The relationships between the biasing magnetic field intensity and magnetizing current are illustrated in FIG. 34, where the solid line shows the uniform biasing magnetic field, and dashed and dot-dashed lines show the magnetic field intersities in the nonuniform illumination that are measured at the center and periphery of the composite structure, respectively.

The composite structure used is prepared by combining a center ferrite disk of saturation magnetization $4\pi M_{s1}=1200$ Gauss with a ferrite ring of $4\pi M_{s2}=750$ Gauss. Their specific permittivities are the same $\epsilon_e=14.5$. The geometry of the composite is such that the radius $r_2$ is 10 mm, the ratio $r_1/r_2$ is 12 mm and the specific permittivity $\epsilon_d$ of the dielectric pervading the stripline is about 3.5.

The circulator performances with uniform and nonuniform biasing magnetic fields are compared. With the uniform magnetic field, the performance as shown in FIG. 32-*a* displays a narrow band operation which is conspicuously bounded by the large insertion losses in the lower frequencies and by a sharp decay of isolation in the higher frequencies. On the other hand, with the nonuniform magnetic field, such large insertion losses in the lower frequencies are improved as shown in FIG. 32-*b*, and the frequency band is therefore broadbanded, although ther is still a sharp decay of isolation in the higher frequencies.

A series of improved perfromances is demonstrated in FIG. 33. The performances are marked by two peaks of isolation and a flatness in low insertion losses. The letters in the figure correspond to sequential variations of the magnetizing current. As the magnetizing current increases, so the isolation is gradually improved amid the frequency band.

To identify the broadband operation, each frequency of maximum isolation measured from FIG. 33 are plotted in the mode chart of the composite structure as shown in FIG. 35. This mode shart is given in terms of relationship between frequency and magnetizing current. The numbers in parentheses indicate the order of resonant mode below resonance, and the plus and minus signs denote clockwise and counterclockwise rotating modes, respectively. It is found that the measured values of maximum isolation lie above the magnetizing current of 0.1 amp, at which the two resonant mode curves $n=+1$ and and $-2$ intersect. The experiments on the broadband operation thus concern the performance of mode 1 which is marked by the magnetic field locus of $H_i=B$ in the first conditional curves shown in FIG. 31-*a*.

Broadband operation of a stripline Y circulator has been performed below resonance, using a F/F composite structure, with a nonuniform biasing magnetic field. It is noted that the frequency band reached 30 percent, without any broadbanding circuit externally connected to the Y-junction.

VI. Miniaturization of composite Y circulators

Miniaturization of a ferrite composite Y circulator is the last item to be mentioned. The idea for miniaturization comes from the fact that increasing of the specific permittivity of the dielectric portion in an F/D composite causes to shift the degenerate point of the resonant mode of $n=1$ downwards in the $k_2r_2$ versus $\kappa/\mu$ diagram, one of which is shown in FIG. 7, and increasing of both the specific permittivity of the dielectric portion and the ratio of $r_1/r_2$ in the F/D composite causes to decrease much more the value of $k_2r_2$ of each mode at degeneracy.

Before entering into detailed discussion, it is necessary to define miniaturization by the ratio of radial wave propagation constant-radius products at degeneracy for the lowest order mode of the TM modes between the disk ferrite and the F/D composite of the present concern. Thus, the definition of miniaturization is simply given by the ratio $k_2r_2/k_er_0$ of the mode $n=1$ at its degeneracy. $k_2r_2$ stands for the degenerate value of the F/D composite and $k_er_0$ for that of the disk ferrite. $k_er_0$ is known to be 1.84 with the disk ferrite.

Resonant mode curves, and relevant circulation conditional curves with the F/D composite have been mentioned with the particular case that the specific permittivity of the center dielectric portion $\epsilon_1$ is 1.0. As is well known with the disk ferrite at degeneracy, the mode of $n=1$ has $k_er_0=1.84$ and the mode of $n=2$ has $k_3r_0=3.05$. As for the F/D composite with $\epsilon_1=1.0$, the mode of $n=1$ has larger vaues of $k_2r_2$ than $k_er_0=1.84$, and the mode of $n=2$ also has larger values of $k_2r_2$ than $k_er_0=3.05$. Thus, the F/D composite has larger values at degeneracy than those of the disk ferrite.

According to computed results of the degenerate value of $k_2r_2$ with the F/D composite, the degenerate value of $k_2r_2$ is decreased if the specific permittivity $\epsilon_1$ is increased. It is noted that the $k_2r_2$ value of degeneracy is 1.33 with the F/D composite having the parameters that $r_1/r_2=0.45$ and $\epsilon_1/\epsilon_2=10$; $k_2r_2$ is 1.05 with the parameters that $r_1/r_2=0.45$ and $\epsilon_1/\epsilon_2=20$; and $k_2r_2$ is 0.68 with the parameters that $r_1/r_2=0.45$ and $\epsilon_1/\epsilon_2=50$. Consequently, the F/D composite with $r_1/r_2=0.45$ can be miniaturized as follows,

| | | | | | |
|---|---|---|---|---|---|
| $k_2r_2/k_er_0$: | ½ | ⅓ | ¼ | 1/5 | 1/10 |
| $\epsilon_1\epsilon_2$: | 28, | 60, | 95, | 115, | 180. |

The reduced size of the F/D composite closely depends on the ratio $r_1/r_2$ in addition to the ratio $\epsilon_1/\epsilon_2$. With the ratio $r_1/r_2$ increased, the F/D composite is more miniaturized with higher ratios of $\epsilon_1/\epsilon_2$.

It is important to note that miniaturization of the F/D composite has influence on resonant modal characteristics but can not disintegrate them, and therefore the basic function to perform multiple circulation frequency operation is inherently preserved.

The disclosed idea can be easily applied to the F/D/C composite circulator. The F/D/C composite circulator with higher ratios of $\epsilon_1/\epsilon_2$ may provide a new miniaturized broadband circulator, as retaining such broadband characteristics disclosed in the preceding embodiments of the present invention.

The center conductive post in the F/D/C composite may have another function to assist miniaturation by being replaced by a conductive post of a short length, or a stack of several thin conductive disks piled up, each being separated from the others by dielectric sheets.

By utilizing cooperative effects produced by the dielectric portion and the center conductive post of such compositive form, the F/D/C composite circulator is considered to be adequate for minaturization of a circulator among the embodiments of the invention. Modification of the F/D/C composite by use of multiple layers of different ferrite materials will be valuable in producing a miniaturized circulator with various performance advantages disclosed in the embodiments of the invention.

Finally, it is remarked that various ferrite composite circulators disclosed in the embodiments of the invention can provide improved and newly disclosed performances originating from the circulator principle of multiple circulation frequency operation, and that all embodiments display various performances only in the range of ferrite anisotropic splitting factor $|\kappa/\mu|$ varying from 0.05 to 0.9, definitely excluding the point of $|\kappa/\mu|=1.0$ and its neighborhood as closely discussed in comparison with the prior art circulators.

What I claim is:

1. A ferrite composite circulator comprising a ferrite-dielectric-conductor composite positioned and centered in a common region having the same size as that of said composite with its axis common to aid common region between two ground planes, said composite being made of a centrally disposed non-magnetic conductive disk, a dielectric ring disposed concentrically with and encircling said conductive disk, and a ferrite ring disposed concentrically with and encircling said dielectric ring, the ratio of the thickness to the radius of said composite being 0.3 or less, means for magnetically biasing said composite so that electromagnetic field energy in aid composite, whose ferrite anisotropic splitting factor $|\kappa/\mu|$ will range between 0.05 and 0.9, is equally resonant in non-, clockwise-, and counterclockwise-rotting modes of various orders determined by a magnetically short-circuited termination at the periphery of said composite, and said modes couple with one another at an operating point within the range of said ferrite anisotropic splitting factor $|\kappa/\mu|$, in order to produce unidirectional waveguiding operation of circulation along with a waveguiding structure in a given frequency band, and a junction having said waveguiding structure forming at least three branches symmetrically extending away in the direction peripendicular to said axis from said common region to three respective ports.

2. A ferrite composite circulator comprising a ferrite-conductor composite positioned and centered in a common region having the same size as that of said composite with its axis common to said common region between two ground planes, said composite being made of a centrally disposed non-magnetic conductive disk and a ferrite ring disposed concentrically with and encircling said conductive disk, the ratio of the thickness to the radius of said composite being 0.3 or less, means for magnetically biasing said composite so that electromagnetic field energy in said composite, whose ferrite anisotropic splitting factor $|\kappa/\mu|$ will range between 0.05 and 0.9, is equally resonant in non-, clockwise:, and counterclockwise-rotating modes of various orders determined by a magnetically short-circuited termination at the periphery of said composite, and said modes couple with one another at an operating point within the range of said ferrite anisotropic splitting factor $|\kappa/\mu|$, in order to produce unidirectional waveguiding operation of circulation along with a waveguiding structure in a given frequency band, and a junction havir g said waveguiding structure forming at least three branches symmetrically extending away in the direction perpendicular to said axis from said common region to three respective ports.

3. A ferrite composite circulator comprising a two-ferrite composite positioned and centered in a common region having its axis common to said composite between two ground planes, said composite being made of a centrally disposed ferrite disk and a ferrite ring contiguously encircling said ferrite disk, each ferrite element having a mutually different saturation magnetization, means for magnetically biasing said composite, by applying externally a biasing magnetic field unidirectionally parallel to said axis to produce commonly unidirectional magnetization in said composite, and a junction having a waveguiding structure forming at least three branches symmetrically extending away in the direction perpendicular to said axis from said common region to three respective ports.

* * * * *